US009371806B2

(12) United States Patent
Aochi et al.

(10) Patent No.: US 9,371,806 B2
(45) Date of Patent: Jun. 21, 2016

(54) SPARK PLUG FOR INTERNAL COMBUSTION ENGINE

(71) Applicant: DENSO CORPORATION, Kariya, Aichi-pref. (JP)

(72) Inventors: Takanobu Aochi, Nishio (JP); Takayuki Inohara, Okazaki (JP); Shinichi Okabe, Aichi-ken (JP); Masamichi Shibata, Toyota (JP); Noriaki Nishio, Ichinomiya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/780,801

(22) PCT Filed: Jan. 28, 2014

(86) PCT No.: PCT/JP2014/051807
§ 371 (c)(1),
(2) Date: Sep. 28, 2015

(87) PCT Pub. No.: WO2014/156272
PCT Pub. Date: Oct. 2, 2014

(65) Prior Publication Data

US 2016/0053733 A1 Feb. 25, 2016

(30) Foreign Application Priority Data

Mar. 28, 2013 (JP) ..... 2013-068430

(51) Int. Cl.
*H01T 13/02* (2006.01)
*F02M 57/06* (2006.01)
*H01T 13/20* (2006.01)

(52) U.S. Cl.
CPC ..... *F02M 57/06* (2013.01); *H01T 13/20* (2013.01)

(58) Field of Classification Search
CPC ..... H01T 13/20; H01T 13/32; H01T 13/02
USPC ..... 313/120, 141
See application file for complete search history.

(56) References Cited

U.S. PATENT DOCUMENTS 8,319,409 B2 11/2012 Kameda
8,552,629 B2 10/2013 Inohara et al.
9,172,214 B2 10/2015 Suzuki

FOREIGN PATENT DOCUMENTS

JP 9-129356 5/1997
JP 9-148045 6/1997

(Continued)

OTHER PUBLICATIONS

International Search Report for PCT/JP2014/051807, mailed Mar. 4, 2014, 4 pages.

(Continued)

*Primary Examiner* — Vip Patel
(74) *Attorney, Agent, or Firm* — Nixon & Vanderhye P.C.

(57) ABSTRACT

A spark plug 1 includes a housing 2, an insulator 3, a center electrode 4 held inside the insulator 3 such that a distal end portion 41 protrudes, a ground electrode 5 including a standing portion 51 and an opposing portion 52, and a guide member 22 that has a guide surface 221 facing the standing portion 51 of the ground electrode 5 and functions to guide a flow of an air-fuel mixture in a combustion chamber of an internal combustion engine to a spark discharge gap G formed between the center electrode 4 and the opposing portion 52 of the ground electrode 5. The opposing portion 52 of the ground electrode 5 has an opposing surface 521 that opposes the center electrode 4, a back surface 522 on the opposite axial side to the opposing surface 521, and a pair of side surfaces 523 and 524 that connect the opposing surface 521 and the back surface 522. Of the pair of side surfaces 523 and 524, at least the side surface 523 on the guide member 22 side is formed so as to make an obtuse angle with the opposing surface 521.

5 Claims, 18 Drawing Sheets

(56) References Cited

FOREIGN PATENT DOCUMENTS

| | | |
|---|---|---|
| JP | 2006-318696 | 11/2006 |
| JP | 2007-273421 | 10/2007 |

OTHER PUBLICATIONS

Written Opinion of the ISA for PCT/JP2014/051807 (Non-English), mailed Mar. 4, 2014, 3 pages.

International Preliminary Report on Patentability dated Oct. 8, 2015 issued in corresponding International Application No. PCT/JP2014/051807.

SPARK PLUG FOR INTERNAL COMBUSTION ENGINE

This application is the U.S. national phase of International Application No. PCT/JP2014/051807 filed 28 Jan. 2014, which designated the U.S. and claims priority to JP Patent Application No. 2013-068430 filed 28 Mar. 2013, the entire contents of each of which are hereby incorporated by reference.

TECHNICAL FIELD

The present invention relates to spark plugs for internal combustion engines of, for example, motor vehicles.

BACKGROUND ART

As ignition means for internal combustion engines of, for example, motor vehicles, there are known spark plugs which have a spark discharge gap formed by opposing a center electrode and a ground electrode in an axial direction. Such spark plugs cause a spark discharge in the spark discharge gap, and ignite an air-fuel mixture in a combustion chamber of an internal combustion engine by the spark discharge.

In the combustion chamber, there is formed a gas flow (i.e., a flow of the air-fuel mixture), such as a swirl flow or tumble flow. With the gas flow moderately flowing also in the spark discharge gap, it is possible to ensure the ignition capability of the spark plug.

However, depending on the mounting state of the spark plug to the internal combustion engine, part of the ground electrode, which is joined to a distal end of a housing, may be located upstream of the spark discharge gap with respect to the gas flow. In this case, the gas flow in the combustion chamber may be blocked by the ground electrode; thus the gas flow in the vicinity of the spark discharge gap may stagnate. As a result, the ignition capability of the spark plug may be lowered. That is, there may be a problem that the ignition capability of the spark plug varies depending on the mounting state of the spark plug to the internal combustion engine. In particular, in recent years, lean-burn internal combustion engines have been widely used; in those internal combustion engines, the combustion stability may be lowered depending on the mounting state of the spark plug.

Moreover, it is difficult to control the mounting state of the spark plug to the internal combustion engine, more specifically the mounting position of the ground electrode of the spark plug to the internal combustion engine. This is because the mounting state varies depending on the state of formation of mounting threads in the housing of the spark plug and the fastening degree of the spark plug in the mounting process to the internal combustion engine.

Accordingly, in Patent Document 1, it is proposed to provide an inclined surface in a side surface of the ground electrode so as to allow the gas flow to be guided to the spark discharge gap even when the ground electrode is located upstream of the spark discharge gap. More specifically, in at least one of a pair of side surfaces of the ground electrode, there is provided an inclined surface that is inclined toward the other side surface as it approaches the center electrode. By this, it is aimed to have the gas flow flowing toward the ground electrode (or the spark discharge gap) along the inclined surface by the Coanda effect.

PRIOR ART LITERATURE

Patent Literature

[PATENT DOCUMENT 1] Japanese Patent Application Publication No. JP2007273421A

SUMMARY OF THE INVENTION

Problems to be Solved by the Invention

However, in practice, the angle of the gas flow changeable by the Coanda effect is small. Therefore, to sufficiently guide the gas flow to the spark discharge gap using the technique disclosed in Patent Document 1, it is necessary to make the ground electrode extremely thin. However, this is hardly a realistic measure in terms of the strength of the ground electrode.

The present invention has been made in view of the above circumstances and aims to provide a spark plug for an internal combustion engine which can ensure a stable ignition capability regardless of the mounting state of it to the internal combustion engine.

Means for Solving the Problems

A spark plug for an internal combustion engine according to the present invention includes: a tubular housing; a tubular insulator held inside the housing; a center electrode held inside the insulator such that a distal end portion protrudes; a ground electrode including a standing portion that stands distalward from a distal end of the housing and an opposing portion that is bent radially inward from the standing portion and opposes the center electrode in an axial direction of the spark plug through a spark discharge gap formed between it and the center electrode; and a guide member for guiding a flow of an air-fuel mixture in a combustion chamber of an internal combustion engine to the spark discharge gap, the guide member protruding distalward from the distal end of the housing at a different circumferential position from the ground electrode and having a guide surface that faces the standing portion of the ground electrode. The spark plug is characterized in that: the opposing portion of the ground electrode has an opposing surface that opposes the center electrode, a back surface on the opposite axial side to the opposing surface, and a pair of side surfaces that connect the opposing surface and the back surface; and of the pair of side surfaces, at least the side surface on the guide member side is formed so as to make an obtuse angle with the opposing surface.

Advantageous Effects of the Invention

The above spark plug includes the guide member. Consequently, regardless of the mounting state of the spark plug to the internal combustion engine, it is possible to prevent the gas flow (i.e., the flow of the air-fuel mixture) in the combustion chamber flowing toward the spark discharge gap from being impeded.

Specifically, when the standing portion of the ground electrode is located, for example, upstream of the spark discharge gap, it is possible to guide the gas flow passing by the standing portion of the ground electrode from the upstream side to the spark discharge gap by the guide member. That is, the guide member constitutes a guide of the gas flow, thereby making it possible to guide the gas flow to the spark discharge gap (hereinafter, this function will be appropriately referred to as "guide function").

However, gas flows in the combustion chamber include a gas flow that has a vector toward the proximal side from the distal side of the spark plug. The introduction of this gas flow to the spark discharge gap is impeded by the opposing portion of the ground electrode. Thus, this gas flow comes to pass both sides of the opposing portion. If this gas flow does not flow in a direction approaching the spark discharge gap, the above-described gas flow, which passes by the standing portion and is guided by the guide member toward the spark discharge gap, may be impeded by the gas flow passing by the opposing portion; thus it may become difficult for the above-described gas flow to be guided to the spark discharge gap.

Therefore, in the above-described spark plug, the side surface of the opposing portion of the ground electrode on the guide member side is formed so as to make the obtuse angle with the opposing surface. Consequently, it is possible to make the direction of the gas flow that passes by the opposing portion on the guide member side be a direction approaching the spark discharge gap. Thus, it is possible to suppress the above-described gas flow that is guided by the guide member toward the spark discharge gap from being impeded by the gas flow passing by the opposing portion. Accordingly, it is possible to prevent stagnation of the gas flows in the vicinity of the spark discharge gap. As a result, it is possible to ensure a stable ignition capability of the spark plug.

As above, according to the present invention, it is possible to provide a spark plug for an internal combustion engine which can ensure a stable ignition capability regardless of the mounting state of it to the internal combustion engine.

BRIEF DESCRIPTION OF THE DRAWINGS

FIG. 10(B) is a schematic view of a spark discharge in the spark plug according to the first comparative example when the standing portion of the ground electrode is located at a position perpendicular to the gas flow, and FIG. 10(C) is a schematic view of a spark discharge in the spark plug according to the first comparative example when the standing portion of the ground electrode is located on the downstream side.

EMBODIMENTS FOR CARRYING OUT THE INVENTION

Figure 1:
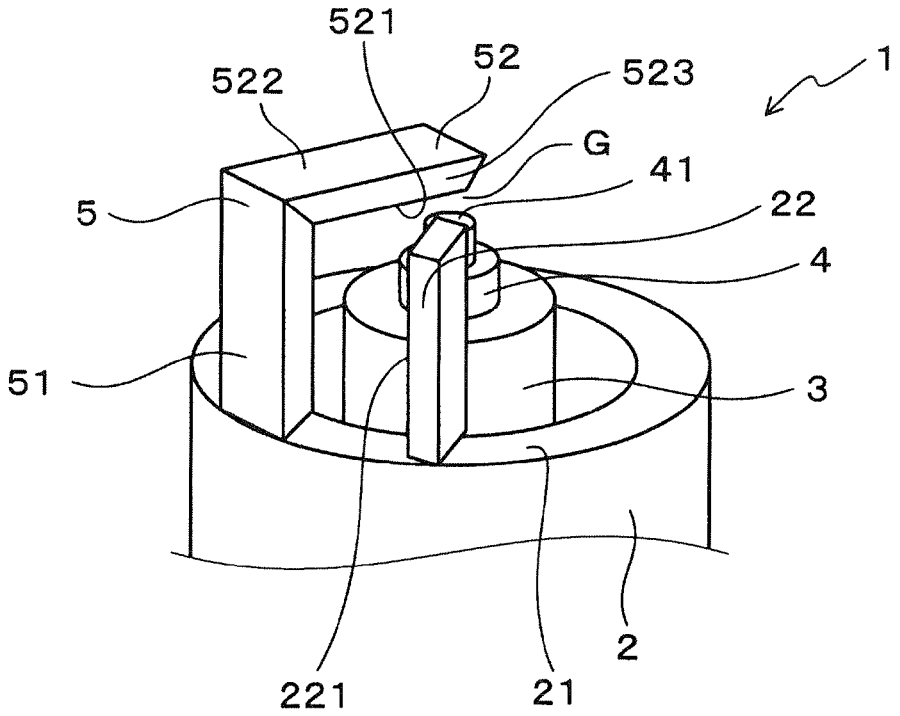
FIG. 1 is a perspective view of a distal part of a spark plug according to a first embodiment.

In the above-described spark plug for an internal combustion engine according to the present invention, the side to be inserted into a combustion chamber is referred to as the distal side; the opposite side is referred to as the proximal side.

Moreover, the side surface of the opposing portion on the guide member side is not necessarily formed so as to make the obtuse angle with the opposing surface over the entire length of the opposing portion in the axial direction of the spark plug. Instead, it is necessary for the side surface of the opposing portion on the guide member side to be formed so as to make the obtuse angle with the opposing surface in a region of more than half the length of the opposing portion in the axial direction of the spark plug.

Moreover, the side surface of the opposing portion on the guide member side is not necessarily formed so as to make the obtuse angle with the opposing surface over the entire length of the opposing portion in a longitudinal direction of the opposing portion. Instead, the side surface of the opposing portion on the guide member side may be formed so as to make the obtuse angle with the opposing surface for only part of the length of the opposing portion in the longitudinal direction. In this case, it is preferable for the side surface to be inclined at the obtuse angle to the opposing surface in a part of the opposing portion close to the spark discharge gap.

Moreover, it is preferable for the opposing portion of the ground electrode to have, in the shape of a cross section perpendicular to the longitudinal direction of the opposing portion, a width of the opposing surface less than a width of the back surface.

Moreover, the standing portion of the ground electrode has a radially inner side surface that faces the center electrode, a radially outer side surface on the opposite radial side to the radially inner side surface, and a pair of circumferential side surfaces that connect the radially inner side surface and the radially outer side surface. It is preferable that of the pair of circumferential side surfaces, at least the circumferential side surface on the guide member side is formed so as to make an obtuse angle with the radially inner side surface. In this case, when the standing portion of the ground electrode is located upstream of the spark discharge gap, it is possible to more effectively guide the gas flow, which passes by the standing portion of the ground electrode from the upstream side, to the spark discharge gap. More specifically, with the circumferential side surface of the standing portion on the guide member side formed so as to make the obtuse angle with the radially inner side surface, it becomes easy for the gas flow guided by the guide function of the guide member to flow along the circumferential side surface of the standing portion. Accordingly, it becomes easy for the gas flow passing between the standing portion and the guide member to be more effectively guided to the spark discharge gap.

Moreover, the circumferential side surface of the standing portion on the guide member side is not necessarily formed so as to make the obtuse angle with the radially inner side surface over the entire length of the standing portion in the radial direction of the spark plug. Instead, it is necessary for the circumferential side surface of the standing portion on the guide member side to be formed so as to make the obtuse angle with the radially inner side surface in a region of more than half the length of the standing portion in the radial direction of the spark plug.

Moreover, the circumferential side surface of the standing portion on the guide member side is not necessarily formed so as to make the obtuse angle with the radially inner side surface over the entire length of the standing portion in a longitudinal direction of the standing portion. Instead, the circumferential side surface of the standing portion on the guide member side may be formed so as to make the obtuse angle with the radially inner side surface for only part of the length of the standing portion in the longitudinal direction. In this case, it is preferable for the circumferential side surface to be inclined at the obtuse angle to the radially inner side surface in a part of the standing portion close to the spark discharge gap.

Moreover, it is preferable for the standing portion of the ground electrode to have, in the shape of a cross section perpendicular to the longitudinal direction of the standing portion, a width of the radially inner side surface less than a width of the radially outer side surface.

Moreover, it is preferable for the opposing portion to have, at an end on the opposite side to the standing portion, a small-width part that has a smaller width in a direction perpendicular to both the extending direction (i.e., the longitudinal direction) of the opposing portion and the axial direction of the spark plug than other parts. In this case, it is possible to reduce the width of the opposing portion in the vicinity of the spark discharge gap. Consequently, it is possible to suppress the opposing portion from impeding the gas flow toward the spark discharge gap, thereby improving the ignition capability of the spark plug. Furthermore, with provision of the small-width part, it is easy for a flame core produced in the spark discharge gap to grow; from this perspective as well, it is possible to improve the ignition capability of the spark plug.

Moreover, it is preferable for the guide member to have its distal end located flush with or proximalward from a distal end of the ground electrode and flush with or distalward from a distal end of the insulator. In this case, it is possible to reduce the axial length of the spark plug while ensuring the guide function of the guide member. Consequently, it is possible to prevent the guide member from interfering with a piston in the combustion chamber while ensuring the ignition capability of the spark plug.

Moreover, it is more preferable that the distal end of the guide member is located distalward from a distal end of the center electrode. Further, it is more preferable that the distal end of the guide member is located distalward from the spark discharge gap.

Moreover, it is preferable for the guide member to protrude parallel to the axial direction of the spark plug. In this case, it is possible to prevent stagnation of the gas flow due to the guide member from occurring in the vicinity of the spark discharge gap. Moreover, it is also possible to simplify the shape of the guide member, thereby realizing a spark plug of simple configuration.

In addition, "parallel to the axial direction of the spark plug" encompasses being substantially parallel, though slightly inclined, to the axial direction of the spark plug to such an extent that it is possible to achieve the above-described advantageous effects.

First Embodiment

A spark plug for an internal combustion engine according to the first embodiment will be described with reference to FIGS. 1-8.

Figure 2:
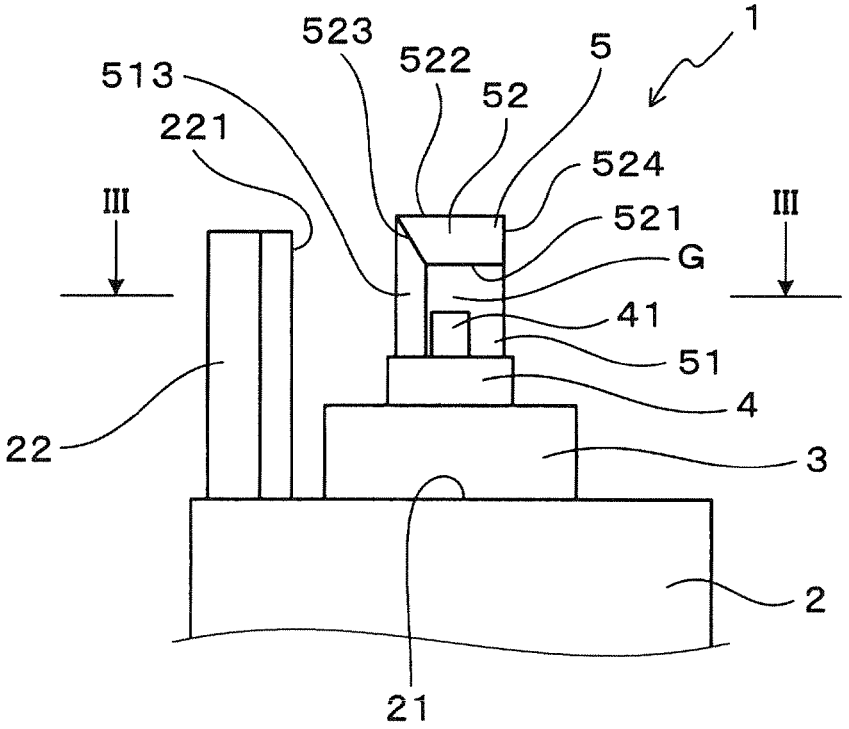
FIG. 2 is a front view of the distal part of the spark plug according to the first embodiment.
Figure 3:
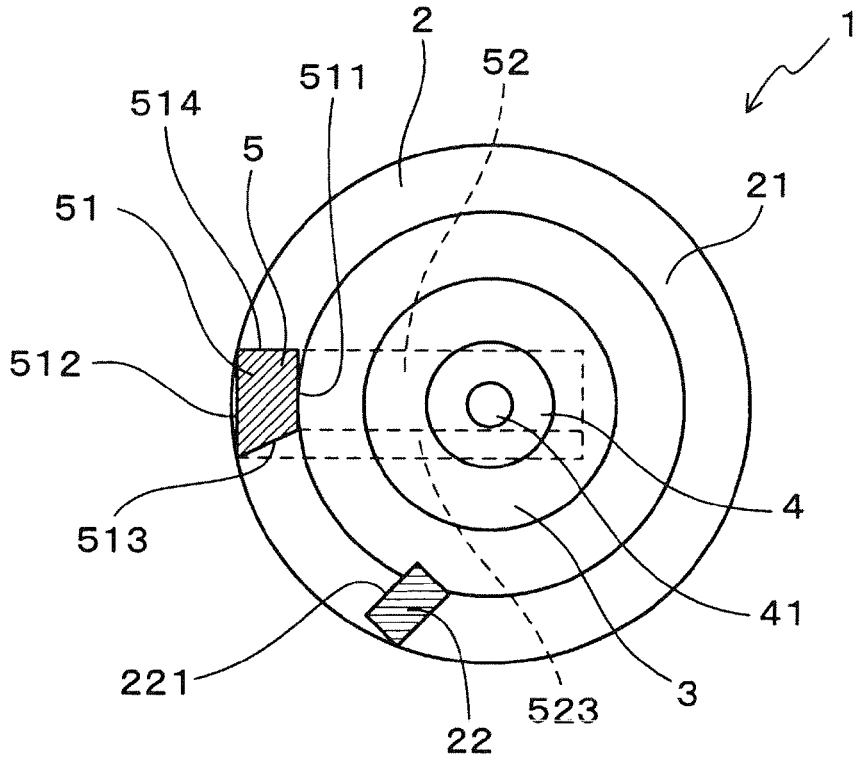
FIG. 3 is a cross-sectional view taken as indicated by arrows in FIG. 2.

As shown in FIGS. 1-3, the spark plug 1 of the present embodiment includes a tubular housing 2, a tubular insulator 3 held inside the housing 2, and a center electrode 4 held inside the insulator 3 such that a distal end portion protrudes.

Moreover, the spark plug 1 further includes a ground electrode 5. The ground electrode 5 includes a standing portion 51 that stands distalward from a distal end 21 of the housing 2 and an opposing portion 52 that is bent radially inward from the standing portion 51 and opposes the center electrode 4 in an axial direction of the spark plug 1 through a spark discharge gap G formed between it and the center electrode 4.

Moreover, the spark plug 1 further includes a guide member 22 for guiding a gas flow (i.e., a flow of an air-fuel mixture) in a combustion chamber of an internal combustion engine to the spark discharge gap G. The guide member 22 protrudes distalward from the distal end 21 of the housing 2 at a different circumferential position from the ground electrode 5 and has a guide surface 221 that faces the standing portion 51 of the ground electrode 5.

Figure 4:
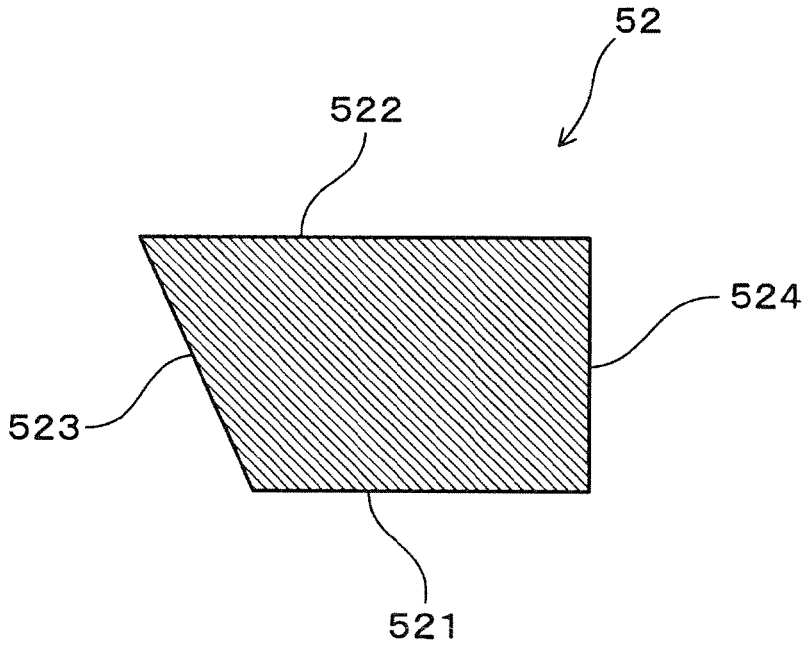
FIG. 4 is a cross-sectional view of an opposing portion of a ground electrode of the spark plug according to the first embodiment.

As shown in FIGS. 2 and 4, the opposing portion 52 of the ground electrode 5 has an opposing surface 521 that opposes the center electrode 4 in the axial direction of the spark plug 1, a back surface 522 on the opposite axial side to the opposing surface 521, and a pair of side surfaces 523 and 524 that connect the opposing surface 521 and the back surface 522. Further, of the pair of side surfaces 523 and 524, at least the side surface 523 on the guide member 22 side is formed so as to make an obtuse angle with the opposing surface 521. In addition, in the present embodiment, the side surface 524 on the opposite side to the guide member 22 is perpendicular to the opposing surface 521 and the back surface 522.

Moreover, the opposing portion 52 of the ground electrode 5 has, in the shape of a cross section perpendicular to a longitudinal direction of the opposing portion 52, a width of the opposing surface 521 less than a width of the back surface 522.

Moreover, in the present embodiment, the side surface 523 of the opposing portion 52 is formed so as to make the obtuse angle with the opposing surface 521 over the entire length of the opposing portion 52 in the axial direction of the spark plug 1. Furthermore, the side surface 523 is formed so as to make the obtuse angle with the opposing surface 521 over the entire length of the opposing portion 52 in the longitudinal direction. The obtuse angle may be set to be, for example, greater than or equal to 100°.

Figure 5:
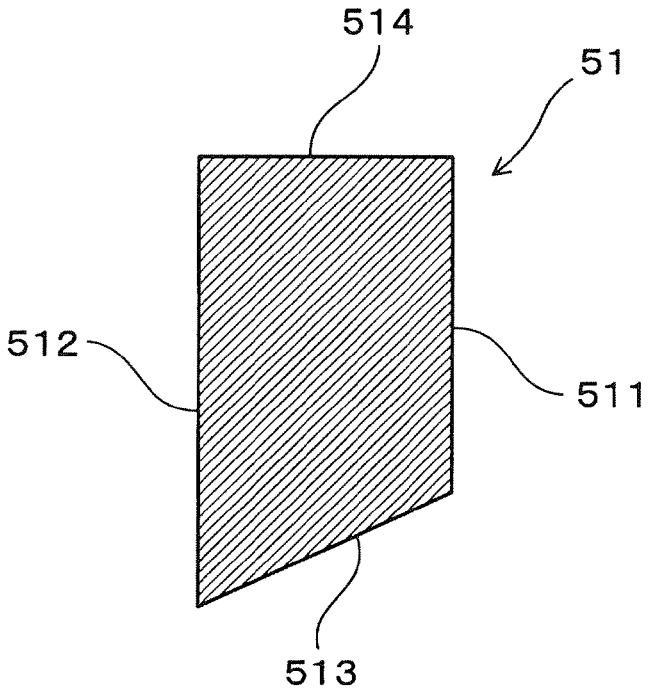
FIG. 5 is a cross-sectional view of a standing portion of the ground electrode of the spark plug according to the first embodiment.

Moreover, as shown in FIGS. 3 and 5, the standing portion 51 of the ground electrode 5 has a radially inner side surface 511 that faces the center electrode 4, a radially outer side surface 512 on the opposite radial side to the radially inner side surface 511, and a pair of circumferential side surfaces 513 and 514 that connect the radially inner side surface 511 and the radially outer side surface 512. Further, of the pair of circumferential side surfaces 513 and 514, the circumferential side surface 513 on the guide member 22 side is formed so as to make an obtuse angle with the radially inner side surface 511. In addition, in the present embodiment, the circumferential side surface 514 on the opposite side to the guide member 22 is perpendicular to the radially inner side surface 511 and the radially outer side surface 512.

Moreover, the standing portion 51 of the ground electrode 5 has, in the shape of a cross section perpendicular to a longitudinal direction of the standing portion 51, a width of the radially inner side surface 511 less than a width of the radially outer side surface 512.

Moreover, the circumferential side surface 513 of the standing portion 51 is formed so as to make the obtuse angle with the radially inner side surface 511 over the entire length of the standing portion 51 in the radial direction of the spark plug 1. Furthermore, the circumferential side surface 513 is formed so as to make the obtuse angle with the radially inner side surface 511 over the entire length of the standing portion 51 in the longitudinal direction. The obtuse angle may be set to be, for example, greater than or equal to 100°.

Figure 6:
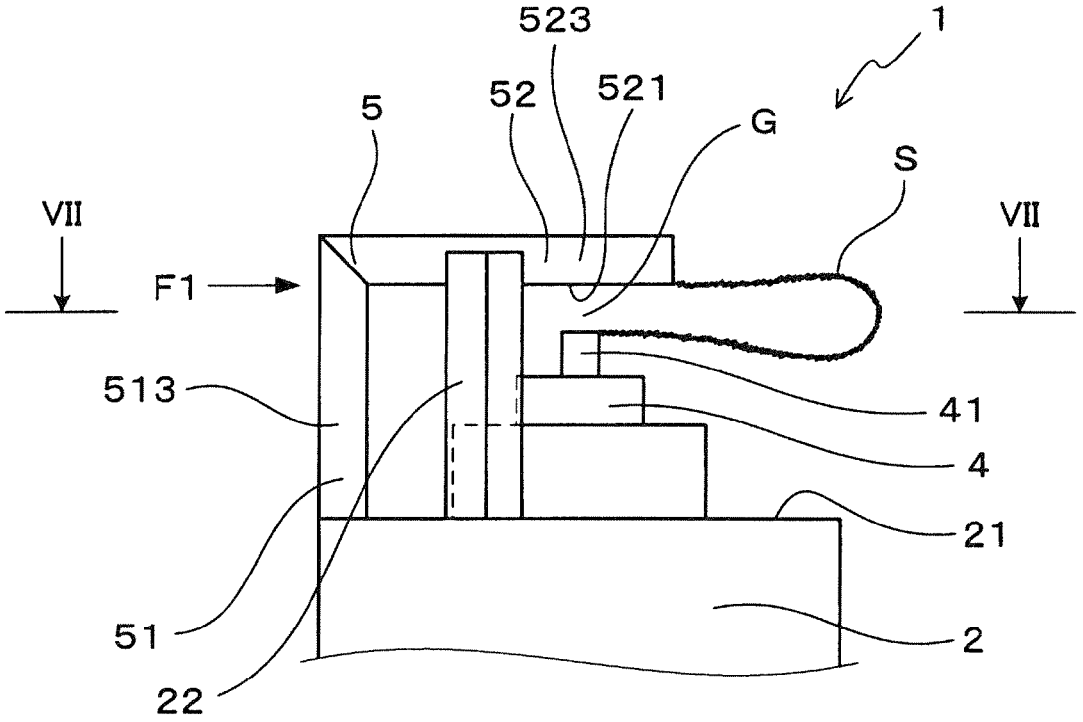
FIG. 6 is a side view of the distal part of the spark plug according to the first embodiment when the standing portion of the ground electrode of the spark plug is located on the upstream side of a gas flow.

Moreover, as shown in FIGS. 1-2 and 6, the guide member 22 protrudes parallel to the axial direction of the spark plug 1. Furthermore, the guide member 22 has its distal end located flush with or proximalward from a distal end of the ground electrode 5 and flush with or distalward from a distal end of the insulator 3. The ground electrode 5 is arranged in a state where the standing portion 51 is parallel to the axial direction of the spark plug 1 and the opposing portion 52 is parallel to the radial direction of the spark plug 1.

Moreover, as shown in FIG. 3, when viewed along the axial direction of the spark plug 1, the guide member 22 is arranged at a circumferential position within 90° from the center of the standing portion 51 of the ground electrode 5. Furthermore, as shown in FIGS. 1 and 3, the guide member 22 has a quadrangular prismatic shape such that the cross section of the guide member 22 in a plane perpendicular to the axial direction of the spark plug 1 has the shape of a rectangle. In addition, one of the surfaces of the guide member 22 that constitute the longer sides of the rectangle is the guide surface 221.

In addition, the spark plug 1 of the present embodiment is to be used in an internal combustion engine of, for example, a motor vehicle.

Next, operational effects of the present embodiment will be described.

The above-described spark plug 1 includes the guide member 22. Consequently, regardless of the mounting state of the spark plug 1 to the internal combustion engine, it is possible to prevent the gas flow in the combustion chamber flowing toward the spark discharge gap G from being impeded.

Figure 7:
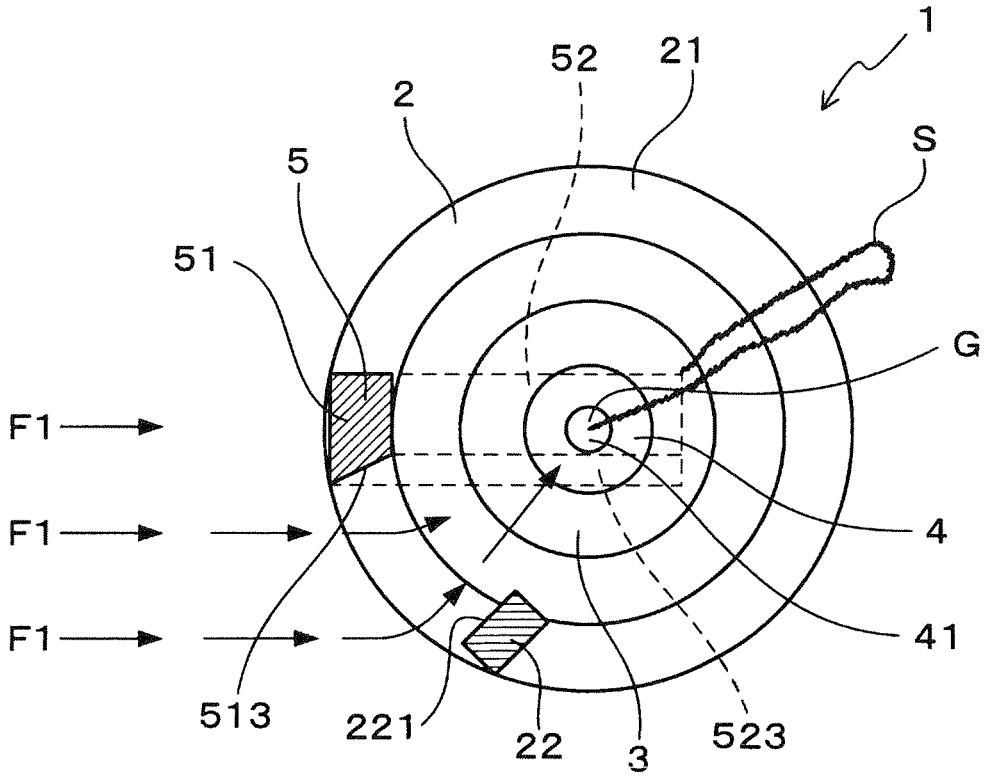
FIG. 7 is a cross-sectional view taken as indicated by arrows VII-VII in FIG. 6.

Specifically, as shown in FIGS. 6-7, when the standing portion 51 of the ground electrode 5 is located, for example, upstream of the spark discharge gap G, it is possible to guide the gas flow F1 passing by the standing portion 51 of the ground electrode 5 from the upstream side to the spark discharge gap G by the guide member 22. That is, the guide member 22 constitutes a guide of the gas flow F1, thereby making it possible to guide the gas flow F1 to the spark discharge gap G.

Figure 8:
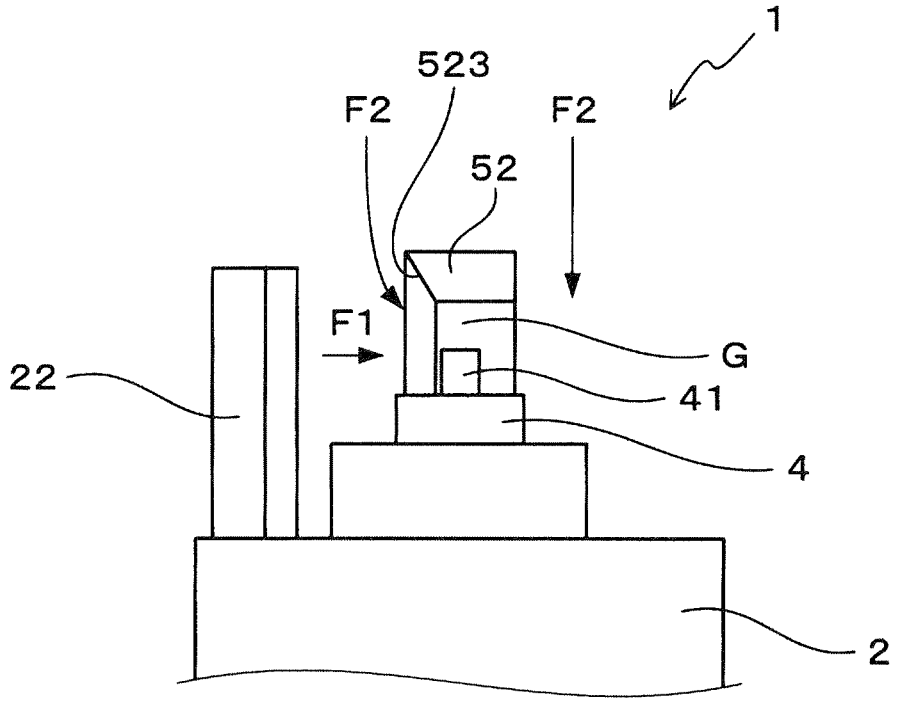
FIG. 8 is a front view of the distal part of the spark plug according to the first embodiment when the standing portion of the ground electrode of the spark plug is located on the upstream side of the gas flow.

However, as shown in FIG. 8, gas flows in the combustion chamber include a gas flow F2 that has a vector toward the proximal side from the distal side of the spark plug 1. The introduction of the gas flow F2 to the spark discharge gap G is impeded by the opposing portion 52 of the ground electrode 5. Thus, the gas flow F2 comes to pass both sides of the opposing portion 52. If the gas flow F2 does not flow in a direction approaching the spark discharge gap G, the above-described gas flow F1, which passes by the standing portion 51 and is guided by the guide member 22 toward the spark discharge gap G, may be impeded by the gas flow F2 passing by the opposing portion 52; thus it may become difficult for the gas flow F1 to be guided to the spark discharge gap G (see the second comparative example to be described later).

Therefore, in the spark plug 1, the side surface 523 of the opposing portion 52 of the ground electrode 5 on the guide member 22 side is formed so as to make the obtuse angle with the opposing surface 521. Consequently, it is possible to make the direction of the gas flow F2 that passes by the opposing portion 52 on the guide member 22 side be a direction approaching the spark discharge gap G. Thus, it is possible to suppress the above-described gas flow F1 that is guided by the guide member 22 toward the spark discharge gap G from being impeded by the gas flow F2 passing by the opposing portion 52. Accordingly, it is possible to prevent stagnation of the gas flows in the vicinity of the spark discharge gap G. As a result, it is possible to ensure a stable ignition capability of the spark plug 1.

Moreover, in the standing portion 51 of the ground electrode 5, the circumferential side surface 513 on the guide member 22 side is formed so as to make the obtuse angle with the radially inner side surface 511. Consequently, as shown in FIG. 7, when the standing portion 51 of the ground electrode 5 is located upstream of the spark discharge gap G, it is possible to more effectively guide the gas flow F1, which passes by the standing portion 51 of the ground electrode 5 from the upstream side, to the spark discharge gap G. More specifically, with the circumferential side surface 513 of the standing portion 51 on the guide member 22 side formed so as to make the obtuse angle with the radially inner side surface 511, it becomes easy for the gas flow F1 guided by the guide function of the guide member 22 to flow along the circumferential side surface 513 of the standing portion 51. Accordingly, it becomes easy for the gas flow F1 passing between the standing portion 51 and the guide member 22 to be more effectively guided to the spark discharge gap G.

Moreover, the guide member 22 has its distal end located flush with or proximalward from the distal end of the ground electrode 5 and flush with or distalward from the distal end of the insulator 3. Consequently, it is possible to reduce the axial length of the spark plug 1 while ensuring the guide function of the guide member 22. As a result, it is possible to prevent the guide member 22 from interfering with a piston in the combustion chamber while ensuring the ignition capability of the spark plug 1.

Moreover, the guide member 22 protrudes parallel to the axial direction of the spark plug 1. Consequently, it is possible to prevent stagnation of the gas flow due to the guide member 22 from occurring in the vicinity of the spark discharge gap G. Moreover, it is also possible to simplify the shape of the guide member 22, thereby realizing the spark plug 1 of simple configuration.

As above, according to the present embodiment, it is possible to provide a spark plug for an internal combustion engine which can ensure a stable ignition capability regardless of the mounting state of it to the internal combustion engine.

First Comparative Example

This example illustrates, as shown in FIGS. 9-12, an ordinary spark plug 9 in which a ground electrode 95 includes a standing portion 951 and an opposing portion 952.

Figure 9:
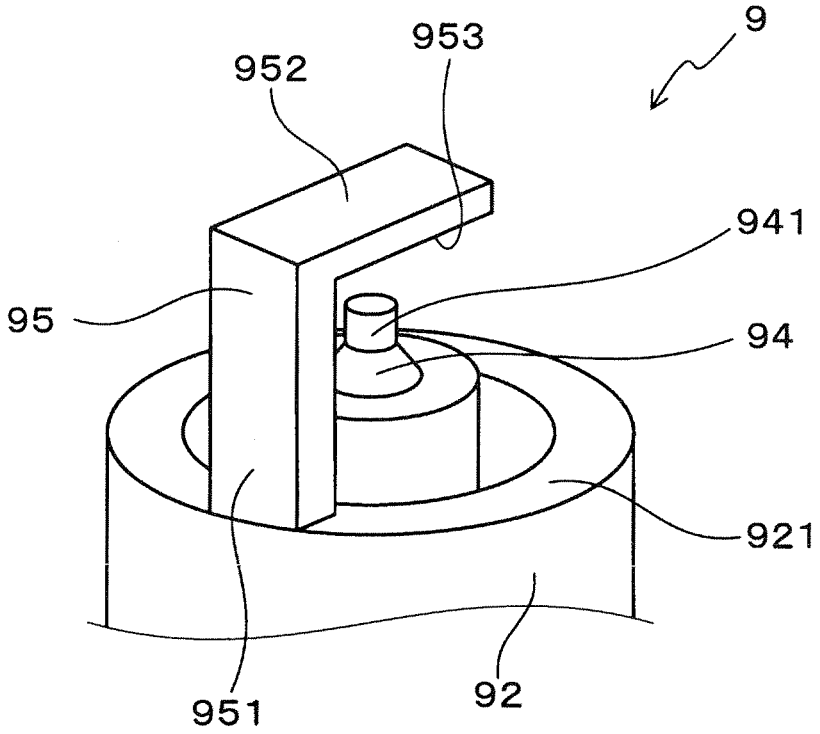
FIG. 9 is a perspective view of a distal part of a spark plug according to a first comparative example.
Figure 10:
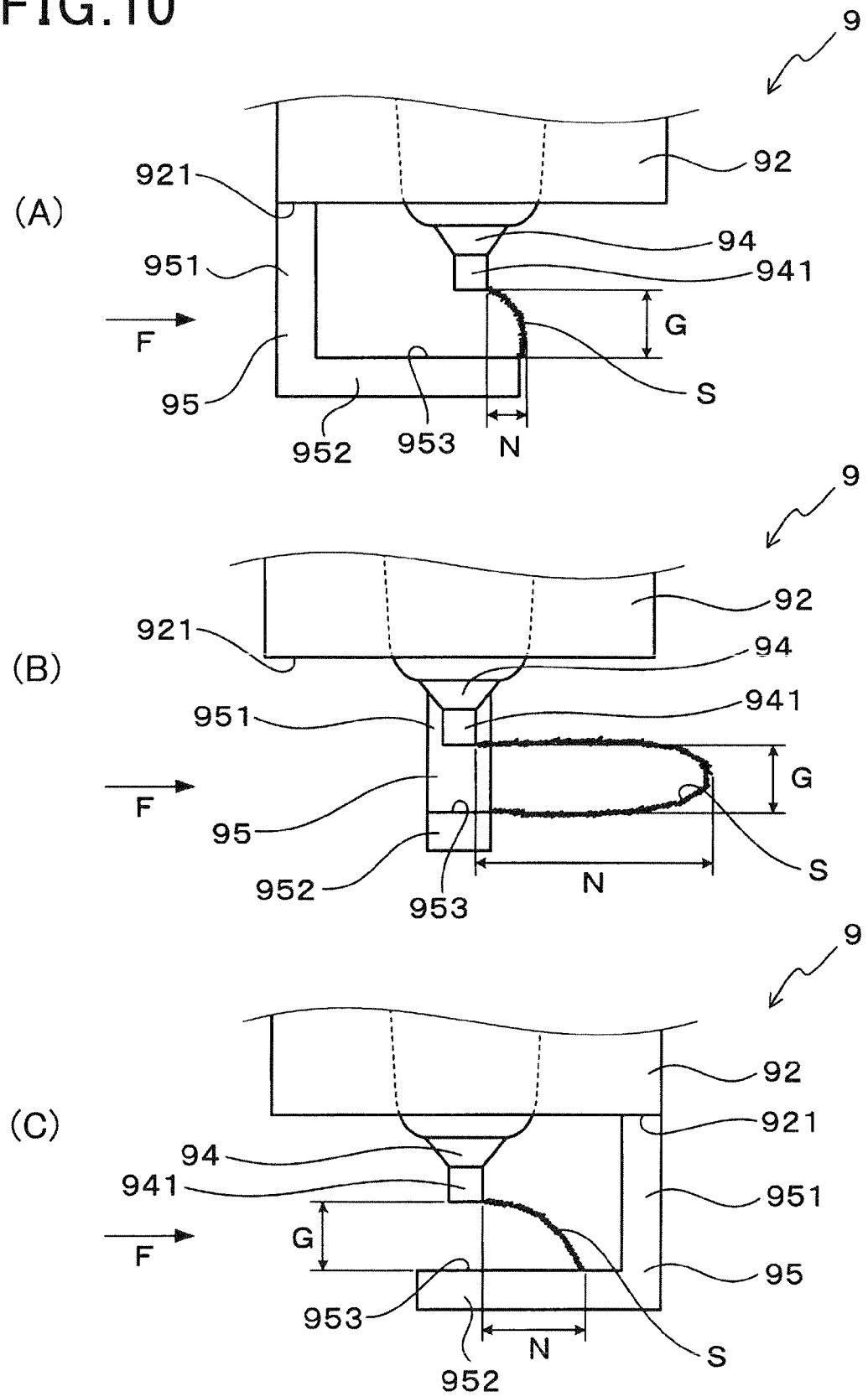
FIG. 10 (A) is a schematic view of a spark discharge in the spark plug according to the first comparative example when the standing portion of the ground electrode is located on the upstream side.

As shown in FIG. 9, the ground electrode 95 includes the standing portion 951 that stands distalward from a distal end 921 of a housing 92 and the opposing portion 952 that is bent from a distal end of the standing portion 951 and has an opposing surface 953 facing a distal end portion 941 of a center electrode 94 in an axial direction of the spark plug 9.

That is, the spark plug 9 does not have a configuration in which a guide member 22 is arranged to protrude distalward from the distal end of the housing as in the first embodiment (see FIG. 1).

The other details are the same as in the first embodiment.

In the present example, when the spark plug 9 is mounted to an internal combustion engine and used, the discharge lengths N of sparks S in the spark discharge gap G vary greatly depending on the mounting state of the spark plug 9 to the internal combustion engine, as shown in FIGS. 10(A)-(C). This depends on the relation with the direction of a gas flow F in a combustion chamber.

More specifically, as shown in FIG. 10(A), when the spark plug 9 is mounted to the internal combustion engine so that the standing portion 951 of the ground electrode 95 is located upstream of the spark discharge gap G, the discharge length N is extremely short.

On the other hand, as shown in FIG. 10(B), when the spark plug 9 is mounted to the internal combustion engine so that the standing portion 951 of the ground electrode 95 is located with respect to the spark discharge gap G at a position perpendicular to the direction of the gas flow F, the discharge length N is extremely long.

Moreover, as shown in FIG. 10(C), when the spark plug 9 is mounted to the internal combustion engine so that the standing portion 951 of the ground electrode 95 is located downstream of the spark discharge gap G, the discharge length N is increased to some extent, but shorter than in the case shown in FIG. 10(B).

In addition, the discharge length N here denotes the spark discharge length in a direction perpendicular to the axial direction of the spark plug.

The above-described manner in which the discharge lengths N vary is knowledge obtained by measuring the discharge lengths N of sparks S in the spark discharge gap G with the flow speed of the gas flow F set to 15 m/s. Specifically, as shown in FIG. 11, there are great differences between the discharge lengths N corresponding to the respective mounting states of the spark plug 9.

Figure 11:
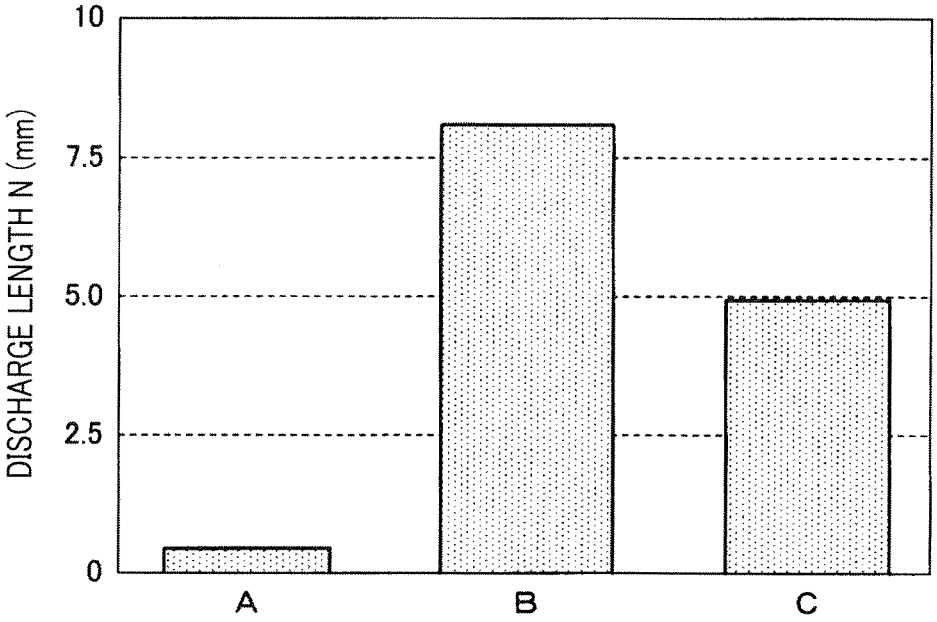
FIG. 11 is a graph comparing discharge lengths in the spark plug according to the first comparative example.

A, B and C in FIG. 11 respectively designate data of the discharge lengths N in the mounting states shown in FIGS. 10(A), (B) and (C).

Figure 12:
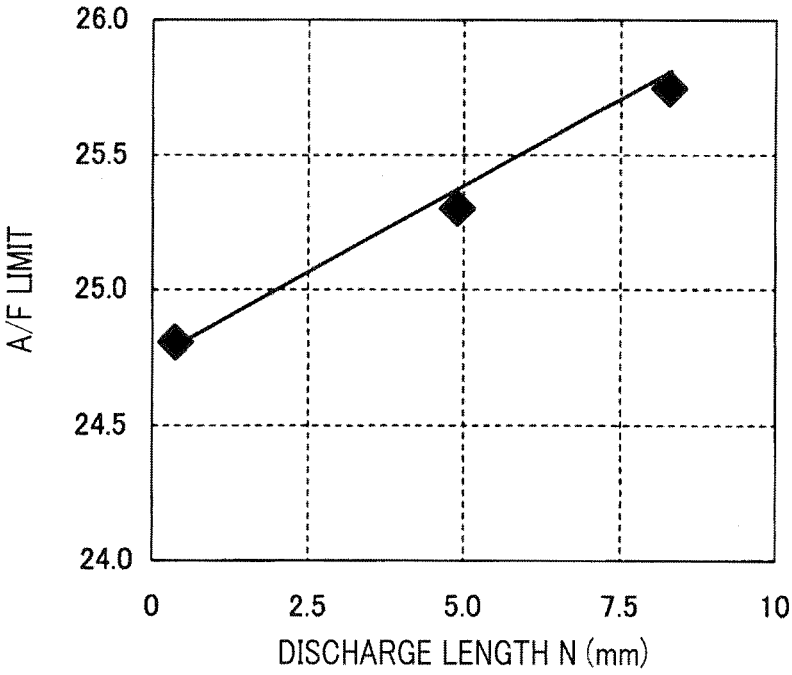
FIG. 12 is a diagram illustrating the relationship between discharge length and A/F limit in the spark plug according to the first comparative example.

Moreover, regarding the relationship between the discharge lengths N and the ignition capability of the spark plug 9, it has been ascertained that as shown in FIG. 12, the longer the discharge lengths N, the more the ignition capability improves. Here, the ignition capability is evaluated based on the A/F limit, i.e., the limit value of air/fuel ratio at which it is possible to ignite the air-fuel mixture. The higher the A/F limit (the leaner the ignitable air-fuel mixture), the higher the ignition capability.

As can be seen from FIGS. 11-12, the ignition capability of the spark plug 9 of the first comparative example varies greatly depending on the mounting state of it to the internal combustion engine.

When the standing portion 951 in the spark plug 9 is located upstream of the spark discharge gap G, the gas flow F is blocked by the standing portion 951 and thus the gas flow in the vicinity of the spark discharge gap G is stagnated, as shown in FIG. 10(A). This is considered to be the main cause of the phenomenon that the discharge length N is extremely short and the ignition capability is lowered. Consequently, it becomes difficult for a spark S to extend, thereby making it difficult to obtain a sufficient discharge length N. As a result, it is difficult for the spark plug 9 to obtain a stable ignition capability.

Second Comparative Example

Figure 13:
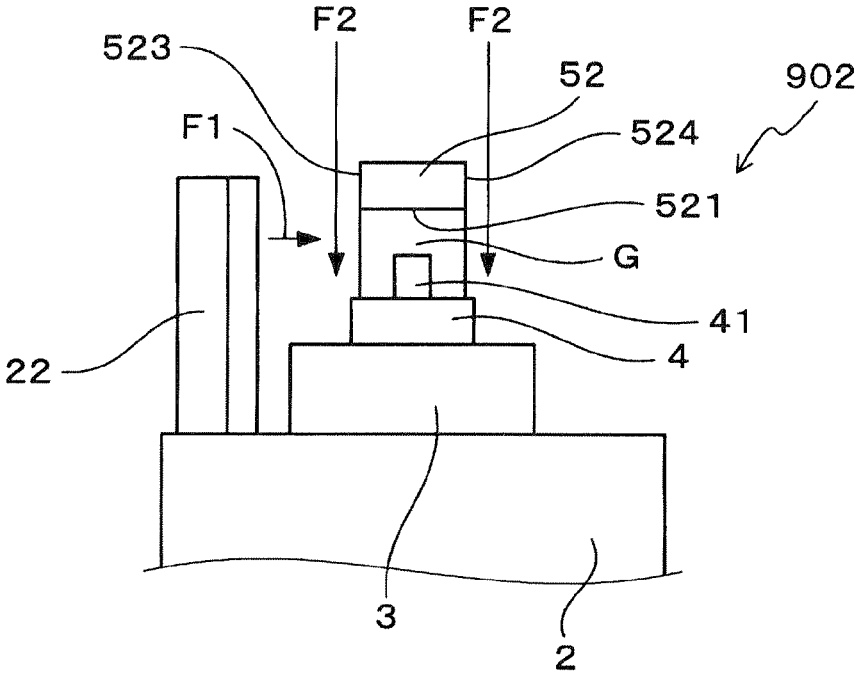
FIG. 13 is a front view of a distal part of a spark plug according to a second comparative example when the standing portion of the ground electrode is located on the upstream side of the gas flow.
Figure 14:
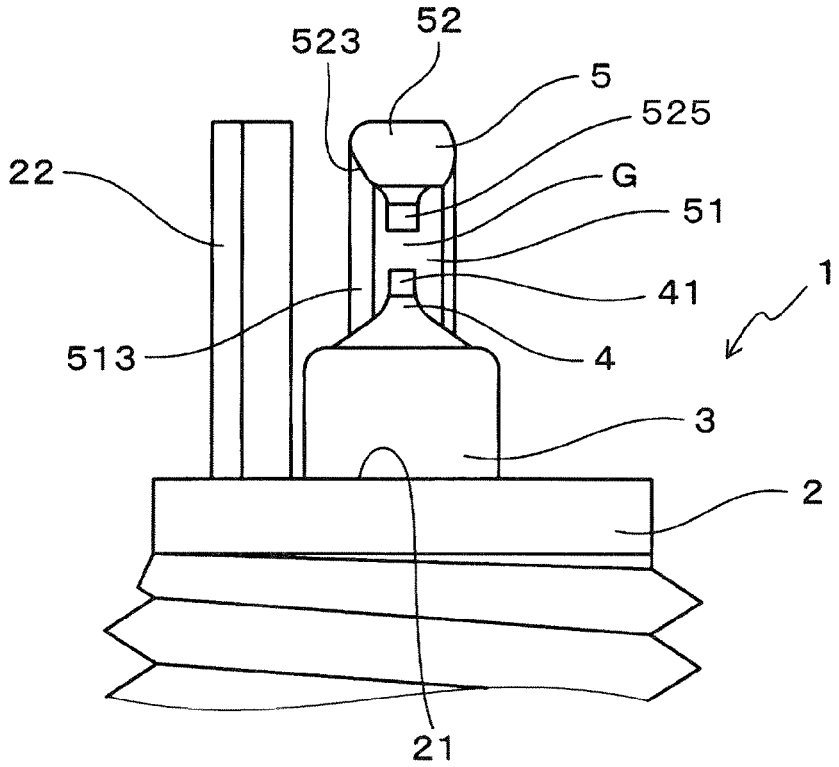
FIG. 14 is a front view of a distal part of a spark plug according to a second embodiment.

In this example, as shown in FIG. 13, the opposing portion 52 of the ground electrode 5 has a rectangular cross-sectional shape.

Specifically, the opposing portion 52 of the ground electrode 5 is formed so that the angles made between the side surfaces 523 and 524 and the opposing surface 521 are right angles. Moreover, the standing portion 51 of the ground electrode 5 also has a rectangular cross-sectional shape. Specifically, the standing portion 51 of the ground electrode 5 is formed so that the angles made between the circumferential side surfaces 513 and 514 and the radially inner side surface 511 are right angles.

The other details are the same as in the first embodiment. In addition, unless specified otherwise, of the reference signs used in the present example and the drawings relating to the present example, those which are the same as the reference signs used in the first embodiment designate the same components as in the first embodiment.

In the spark plug 902 of the present example, when the standing portion 51 of the ground electrode 5 is located upstream of the spark discharge gap G, it is possible to guide the gas flow to the spark discharge gap G by the guide function of the guide member 22.

However, the gas flow F1 that is guided by the guide function of the guide member 22 toward the spark discharge gap G may be impeded by the gas flow F2 that has a vector toward the proximal side from the distal side of the spark plug 1. Specifically, as described previously, gas flows in the combustion chamber include the gas flow F2 that has a vector toward the proximal side from the distal side of the spark plug 1. The introduction of the gas flow F2 to the spark discharge gap G is impeded by the opposing portion 52 of the ground electrode 5. Thus, the gas flow F2 comes to pass both sides of the opposing portion 52.

In the spark plug 902 of the present example, the side surface 523 of the opposing portion 52 of the ground electrode 5 is formed at a right angle with the opposing surface 521. That is, the side surface 523 is formed parallel to the axial direction of the spark plug 902. Therefore, the gas flow F2 passing by the opposing portion 52 flows along the side surface 523 in the axial direction of the spark plug 902. Then, as described above, the gas flow F1 that passes by the standing portion 51 and is guided by the guide member 22 toward the spark discharge gap G may be impeded by the gas flow F2 passing by the opposing portion 52; thus it may become difficult for the gas flow F1 to be guided to the spark discharge gap G.

Second Embodiment

In this embodiment, as shown in FIGS. 14-17, on the opposing surface 521 of the opposing portion 52 of the ground electrode 5, there is disposed an opposing protrusion 525 that is constituted of a noble metal chip.

The opposing protrusion 525 is opposed to the distal end portion 41 of the center electrode 4 with the spark discharge gap G formed between the distal end portion 41 and the opposing protrusion 525. Specifically, the noble metal chip constituting the opposing protrusion 525 is made of a Pt—Rh alloy. Moreover, the distal end portion 41 of the center electrode 4 is also constituted of a noble metal chip, more specifically made of an iridium alloy (Ir—Rh alloy). The opposing protrusion 525 has a substantially cylindrical shape with its diameter being 0.9 mm and its protruding height from the opposing surface 521 being 0.8 mm. Furthermore, the distal end portion 41 of the center electrode 4 also has a substantially cylindrical shape with its diameter being 0.7 mm. In addition, the size of the spark discharge gap G is 1.05 mm.

Moreover, the distal end portion 41 of the center electrode 4 axially protrudes from the distal end of the insulator 3 by 1.5 mm. The housing 2 and the main body of the ground electrode 5 are made of a nickel alloy. The diameter of the housing 2 is 10.2 mm, and the thickness of the housing 2 at the distal end 21 is 1.45 mm.

Figure 15:
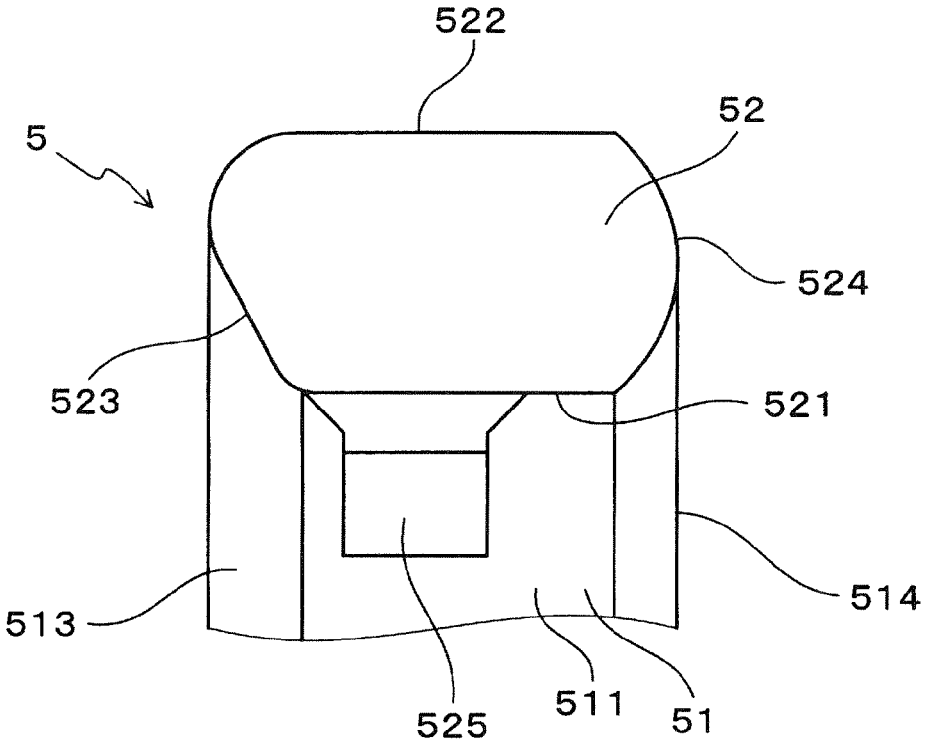
FIG. 15 is a front view of an opposing portion of a ground electrode of the spark plug according to the second embodiment.

As shown in FIG. 15, the opposing portion 52 of the ground electrode 5 is formed so that the side surface 523 on the guide member 22 side is inclined at an obtuse angle to the opposing surface 521. Moreover, the side surface 524 of the opposing portion 52 on the opposite side to the guide member 22 is formed as a curved surface. The radius of curvature of the curved surface is 0.8 mm. Furthermore, between the side surface 523 and the opposing surface 521, there is formed a curved chamfer whose radius of curvature is 0.2 mm.

Moreover, between the side surface 523 and the back surface 522, there is also formed a curved chamfer whose radius of curvature is 0.4 mm. The angle between the side surface 523 and the back surface 522 is 63.4°. That is, the angle between the side surface 523 and the opposing surface 521 is 116.6°. The opposing portion 52 of the ground electrode 5 has its thickness in the axial direction of the spark plug 1 equal to 1.3 mm and its width in a direction perpendicular to both the axial direction of the spark plug 1 and the longitudinal direction of the opposing portion 52 equal to 2.4 mm.

In addition, the cross-sectional shape of the standing portion 51 of the ground electrode 5 is the same as the cross-sectional shape of the opposing portion 52. That is, the ground electrode 5 is formed by bending a bar-like body having the above-described cross-sectional shape to include the standing portion 51 and the opposing portion 52.

Figure 16:
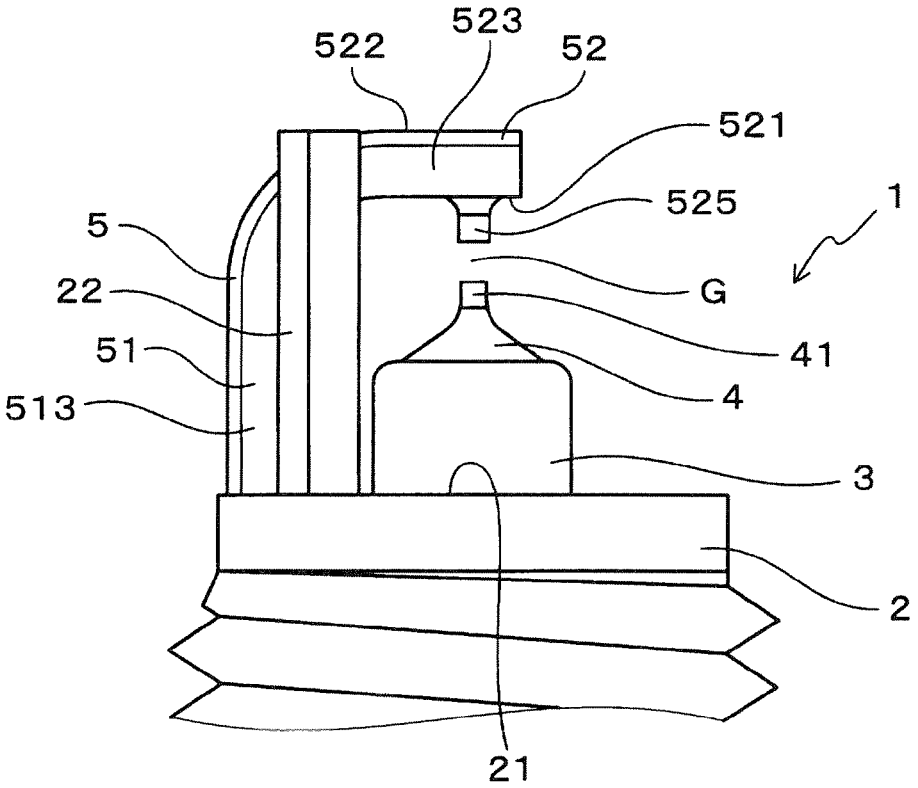
FIG. 16 is a side view of the distal part of the spark plug according to the second embodiment.
Figure 17:
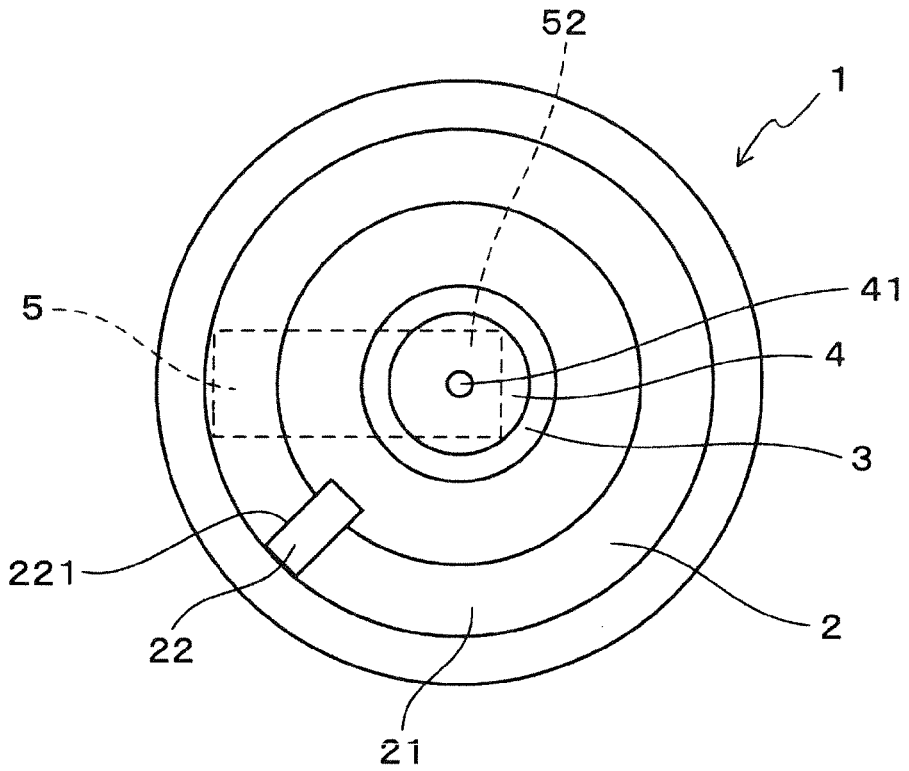
FIG. 17 is a plan view, from the distal side, of the distal part of the spark plug according to the second embodiment.

Moreover, as shown in FIGS. 16-17, the guide member 22 has a substantially quadrangular prismatic shape. The cross section of the guide member 22 in a plane perpendicular to the axial direction of the spark plug 1 has a substantially rectangular shape. The substantially rectangular shape has its dimension in a direction parallel to the guide surface 221 equal to 1.8 mm and its dimension in a direction perpendicular to the guide surface 221 equal to 1.2 mm. Furthermore, the protruding height of the guide member 22 from the distal end 21 of the housing 2 is 7 mm, which is equal to the protruding height of the ground electrode 5 from the distal end 21 of the housing 2.

Moreover, the guide member 22 is disposed so that when viewed along the axial direction of the spark plug 1, a straight line extending through the center of the guide member 22 and parallel to the guide surface 221 passes the plug center (the spark discharge gap G). Further, the straight line extending through the center of the guide member 22 and parallel to the guide surface 221 and a straight line extending through the center of the standing portion 51 of the ground electrode 5 and parallel to the opposing portion 52 make an angle of 45° with each other.

The other details are the same as in the first embodiment. In addition, unless specified otherwise, of the reference signs used in the present embodiment and the drawings relating to the present embodiment, those which are the same as the reference signs used in the first embodiment designate the same components as in the first embodiment.

In the present embodiment, it is possible to achieve the same operational effects as in the first embodiment. In addition, the operational effects of the present embodiment are specifically supported by first and second experiments which will be described later.

Third Comparative Example

Figure 18:
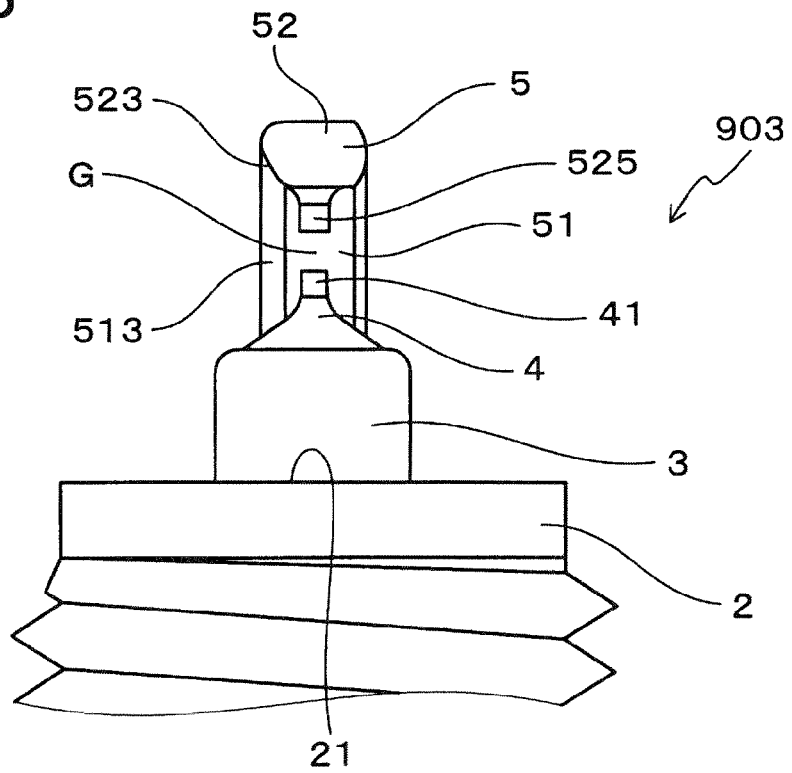
FIG. 18 is a front view of a distal part of a spark plug according to a third comparative example.
Figure 19:
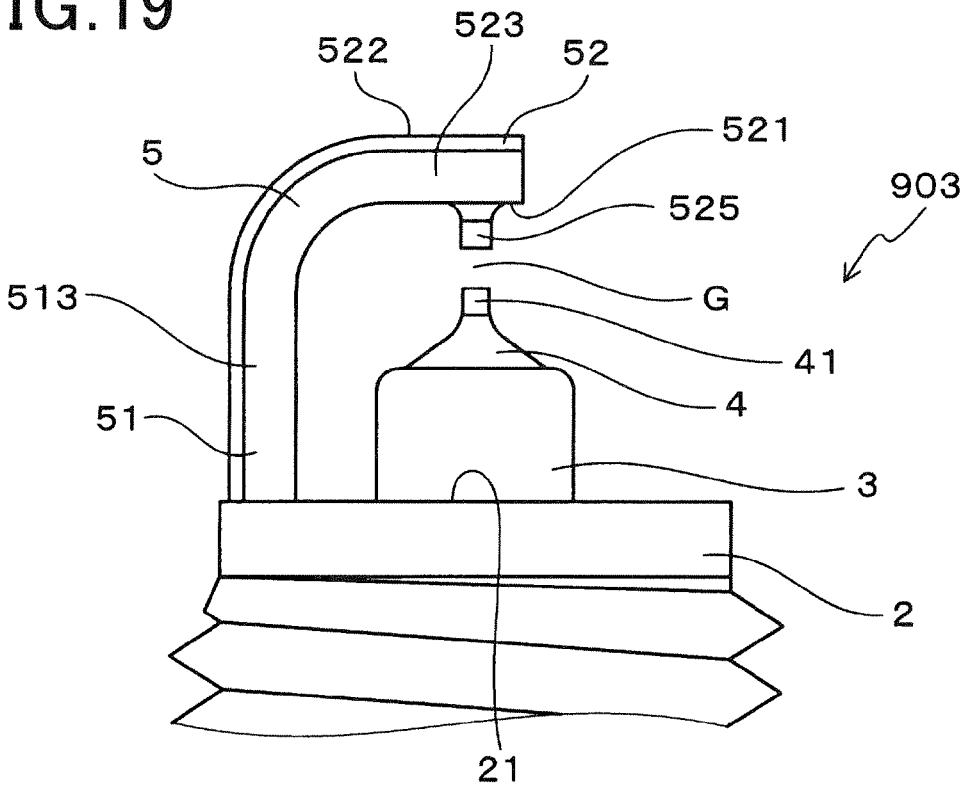
FIG. 19 is a side view of the distal part of the spark plug according to the third comparative example.
Figure 20:
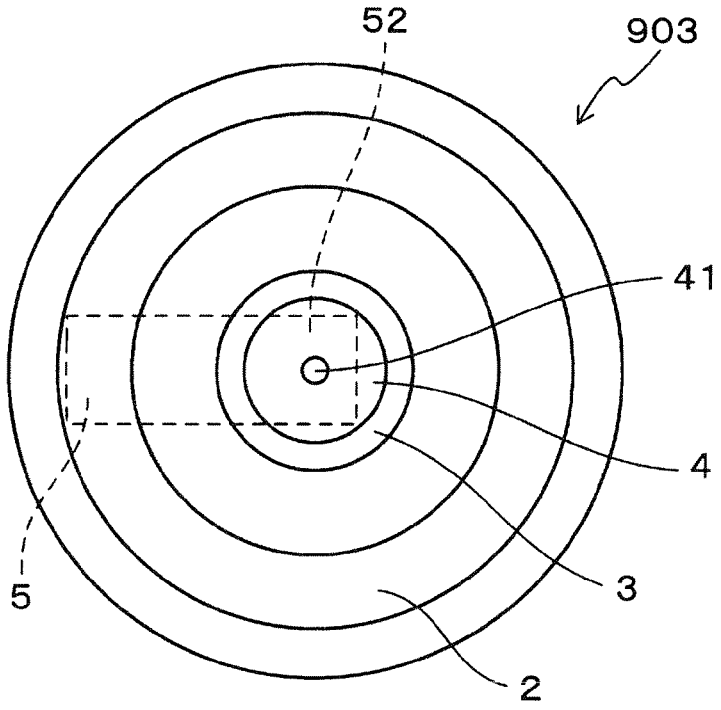
FIG. 20 is a plan view, from the distal side, of the distal part of the spark plug according to the third comparative example.

This example illustrates, as shown in FIGS. 18-20, a spark plug 903 that is obtained by removing the guide member 22 from the spark plug 1 of the second embodiment. The other details are the same as in the second embodiment. In addition, unless specified otherwise, of the reference signs used in the present example and the drawings relating to the present example, those which are the same as the reference signs used in the second embodiment designate the same components as in the second embodiment.

Fourth Comparative Example

Figure 21:
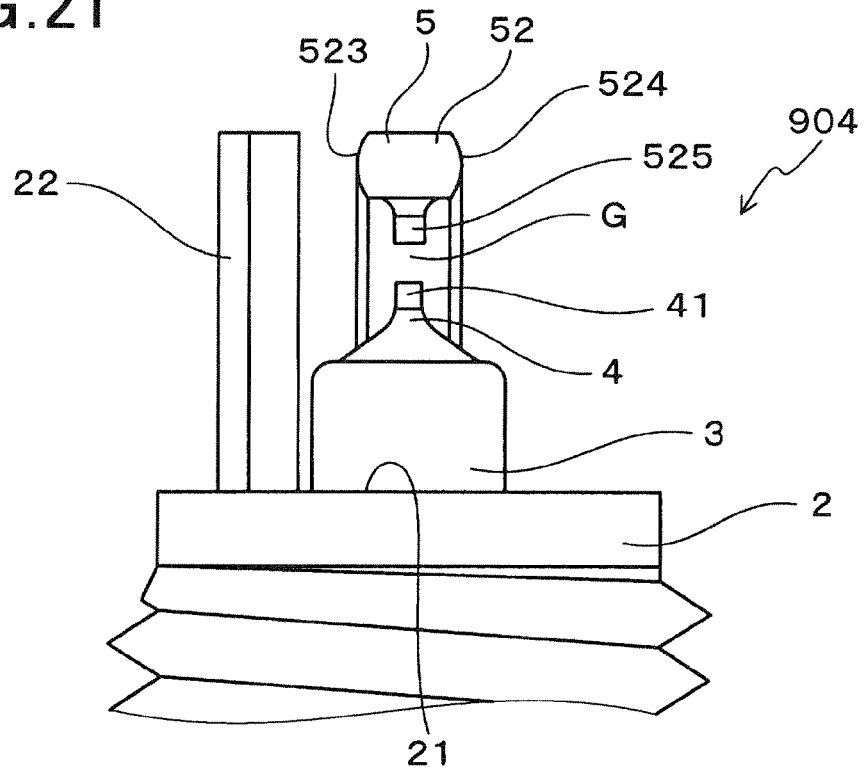
FIG. 21 is a front view of a distal part of a spark plug according to a fourth comparative example.
Figure 22:
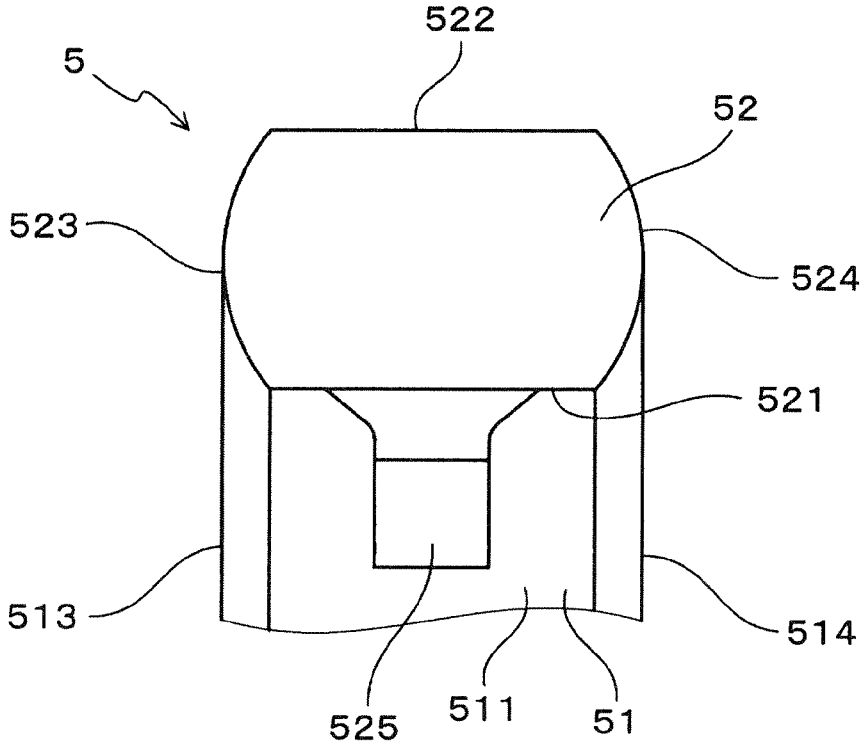
FIG. 22 is a front view of an opposing portion of a ground electrode of the spark plug according to the fourth comparative example.
Figure 23:
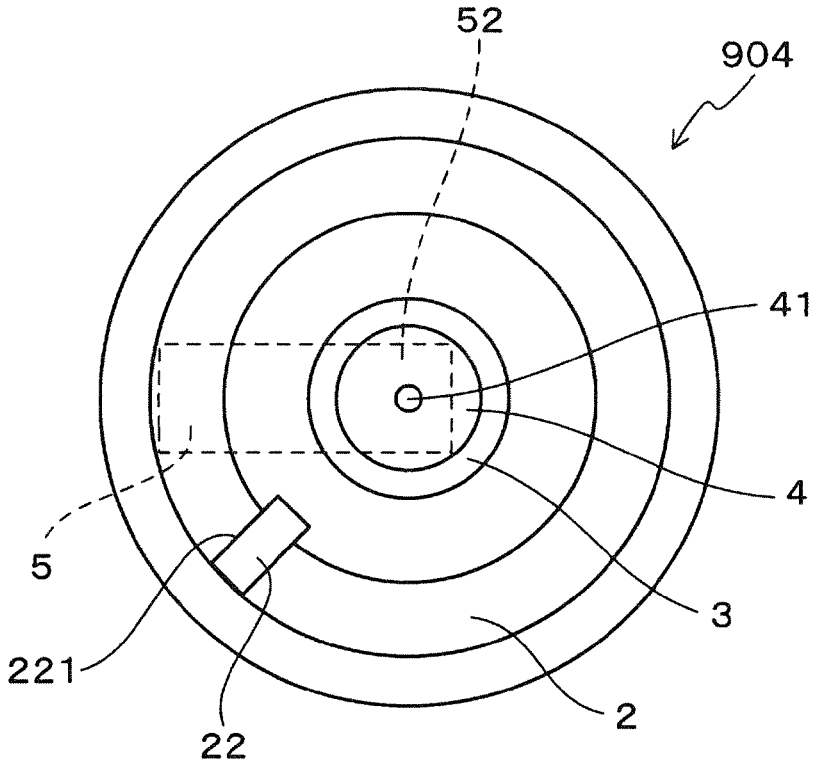
FIG. 23 is a plan view, from the distal side, of the distal part of the spark plug according to the fourth comparative example.

This example illustrates, as shown in FIGS. 21-23, a spark plug 904 that is obtained by modifying the cross-sectional shape of the opposing portion 52 in the spark plug 1 of the second embodiment to a substantially rectangular shape.

Specifically, similar to the second comparative example, the cross-sectional shape of the opposing portion 52 is modified to a substantially rectangular shape; thus neither of the side surfaces 523 and 524 is inclined at an obtuse angle to the opposing surface 521. However, strictly speaking, as shown in FIG. 22, the side surfaces 523 and 524 of the opposing portion 52 are curved surfaces. Moreover, the radii of curvature of the curved surfaces are 0.8 mm. The opposing portion 52 has its thickness in the axial direction of the spark plug 904 equal to 1.3 mm and its width in a direction perpendicular to both the axial direction of the spark plug 904 and the longitudinal direction of the opposing portion 52 equal to 2.6 mm.

The other details are the same as in the second embodiment. In addition, unless specified otherwise, of the reference signs used in the present example and the drawings relating to the present example, those which are the same as the reference signs used in the second embodiment designate the same components as in the second embodiment.

Fifth Comparative Example

Figure 24:
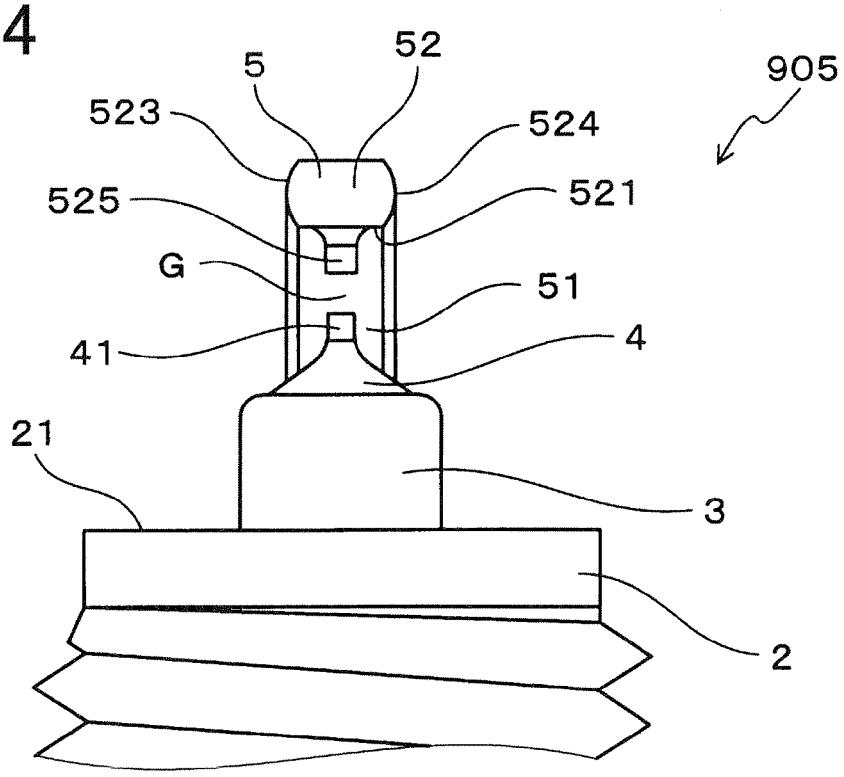
FIG. 24 is a front view of a distal part of a spark plug according to a fifth comparative example.

This example illustrates, as shown in FIG. 24, a spark plug 905 which has no guide member 22 as in the third comparative example and in which the cross-sectional shape of the opposing portion 52 is a substantially rectangular shape as in the fourth comparative example.

The shape of the opposing portion 52 is the same as in the fourth comparative example. That is, the present example differs from the fourth comparative example only in that no guide member 22 is provided in the present example. The other details are the same as in the fourth comparative example. In addition, unless specified otherwise, of the reference signs used in the present example and the drawings relating to the present example, those which are the same as the reference signs used in the fourth comparative example designate the same components as in the fourth comparative example.

(First Experiment)

Figure 25:
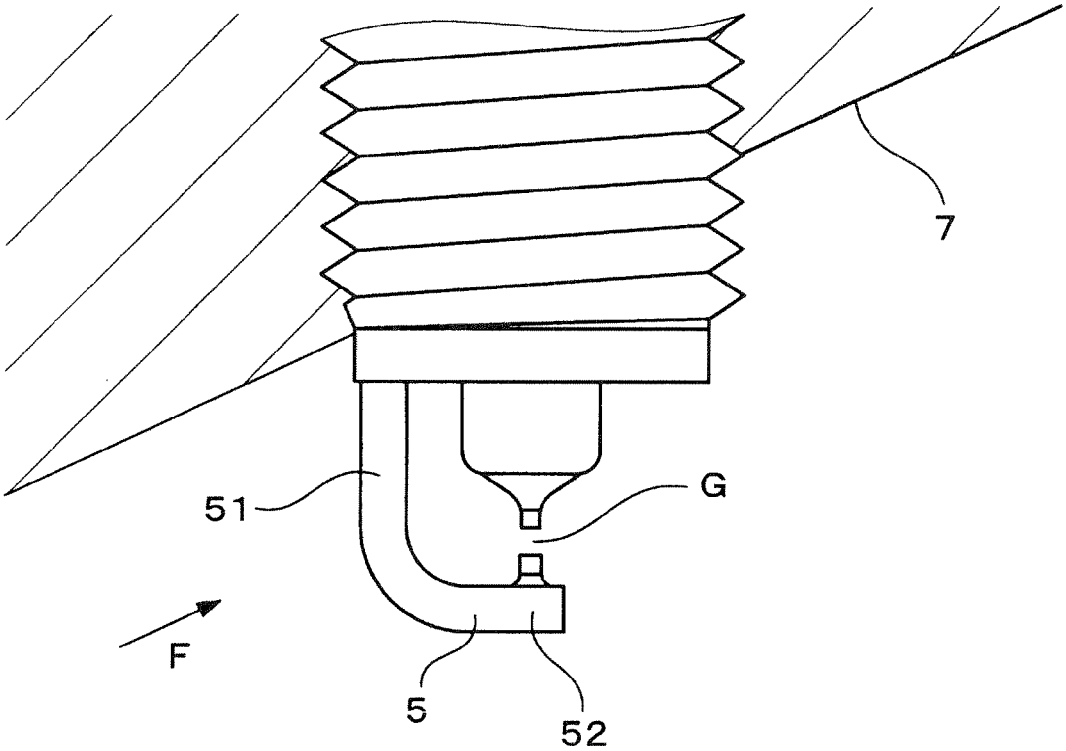
FIG. 25 is a schematic view illustrating a test method in a first experiment.
Figure 26:
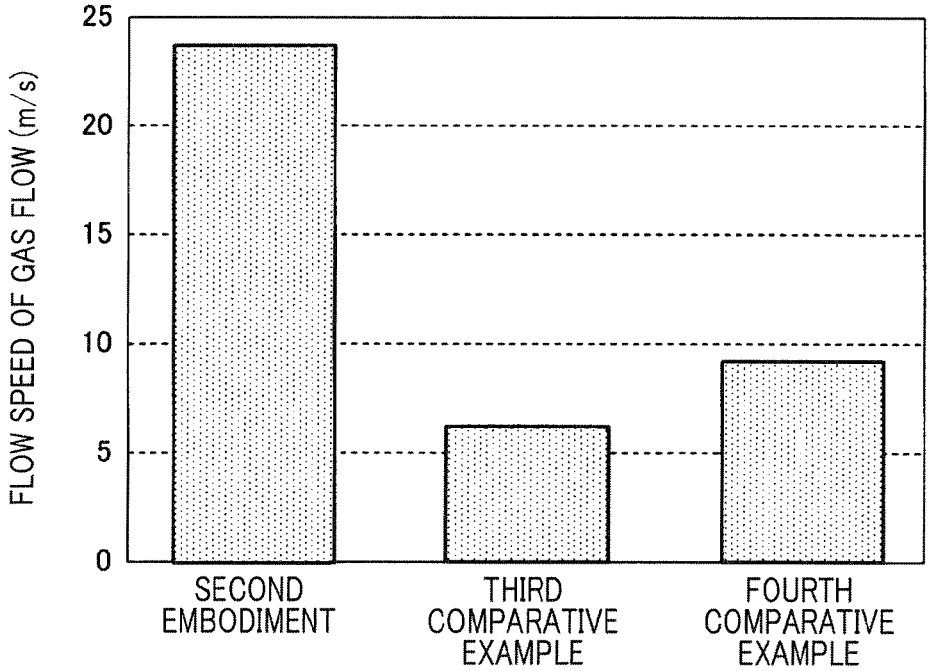
FIG. 26 is a diagram showing test results in the first experiment.

In this experiment, as shown in FIGS. 25-26, for the spark plugs of the second embodiment FIGS. 14-17), the third comparative example (FIGS. 18-20) and the fourth comparative example (FIGS. 21-23), the ignition capabilities thereof were indirectly evaluated.

As shown in FIG. 25, each of the spark plugs was installed in a chamber so that the standing portion 51 of the ground electrode 5 was located upstream of the spark discharge gap G with respect to the gas flow whose flow speed was 20 m/s. Here, the gas flow F was oblique to the axial direction of the spark plug. Specifically, the direction of the gas flow F was from the distal side of the axial direction of the spark plug and the side of the standing portion 51 of the ground electrode 5 to the proximal side of the axial direction of the spark plug and the opposite side to the standing portion 51. The angle between the gas flow F and the axial direction of the spark plug was set to 65°. That is, the gas flow F had a vector toward the proximal side from the distal side in the axial direction of the spark plug. In addition, to facilitate reproduction of the direction of the gas flow F, the wall surface 7 of the chamber, from which the spark plug was protruded, was inclined at 65° to the axial direction of the spark plug, thus becoming parallel to the gas flow F.

In such a condition, each of the spark plugs was installed and the flow speed of the gas flow in the spark discharge gap G was measured.

When the flow speed of the gas flow in the spark discharge gap G is low, the discharge length of a spark is short. Moreover, it has been ascertained that the ignition capability is lowered as the discharge length becomes short (see FIG. 12). Therefore, by measuring the flow speed of the gas flow in the spark discharge gap G, it is possible to indirectly evaluate the ignition capability.

The measurement results are shown in FIG. 26. The flow speed of the gas flow was measured at twelve spots on the central axis of the center electrode 4 in the spark discharge gap G; the maximum flow speed was used to evaluate the ignition capability.

As can be seen from FIG. 26, in the spark plugs of the third and fourth comparative examples, the flow speed in the spark discharge gap G was lower than half the flow speed (20 m/s) of the main stream of the supplied gas flow. In contrast, in the spark plug of the second embodiment, the flow speed of the gas flow in the spark discharge gap G was equal to or higher than the flow speed (20 m/s) of the main stream of the supplied gas flow.

As can be seen from the results of the present experiment, in the spark plug of the second embodiment, in the case where there is created in the combustion chamber a gas flow having an axial vector, it is possible to sufficiently secure the gas flow in the spark discharge gap G even when the standing portion 51 of the ground electrode 5 is located on the upstream side of the gas flow. Consequently, even in such a case, it is possible to ensure a stable ignition capability of the spark plug 1 of the second embodiment.

(Second Experiment)

Figure 27:
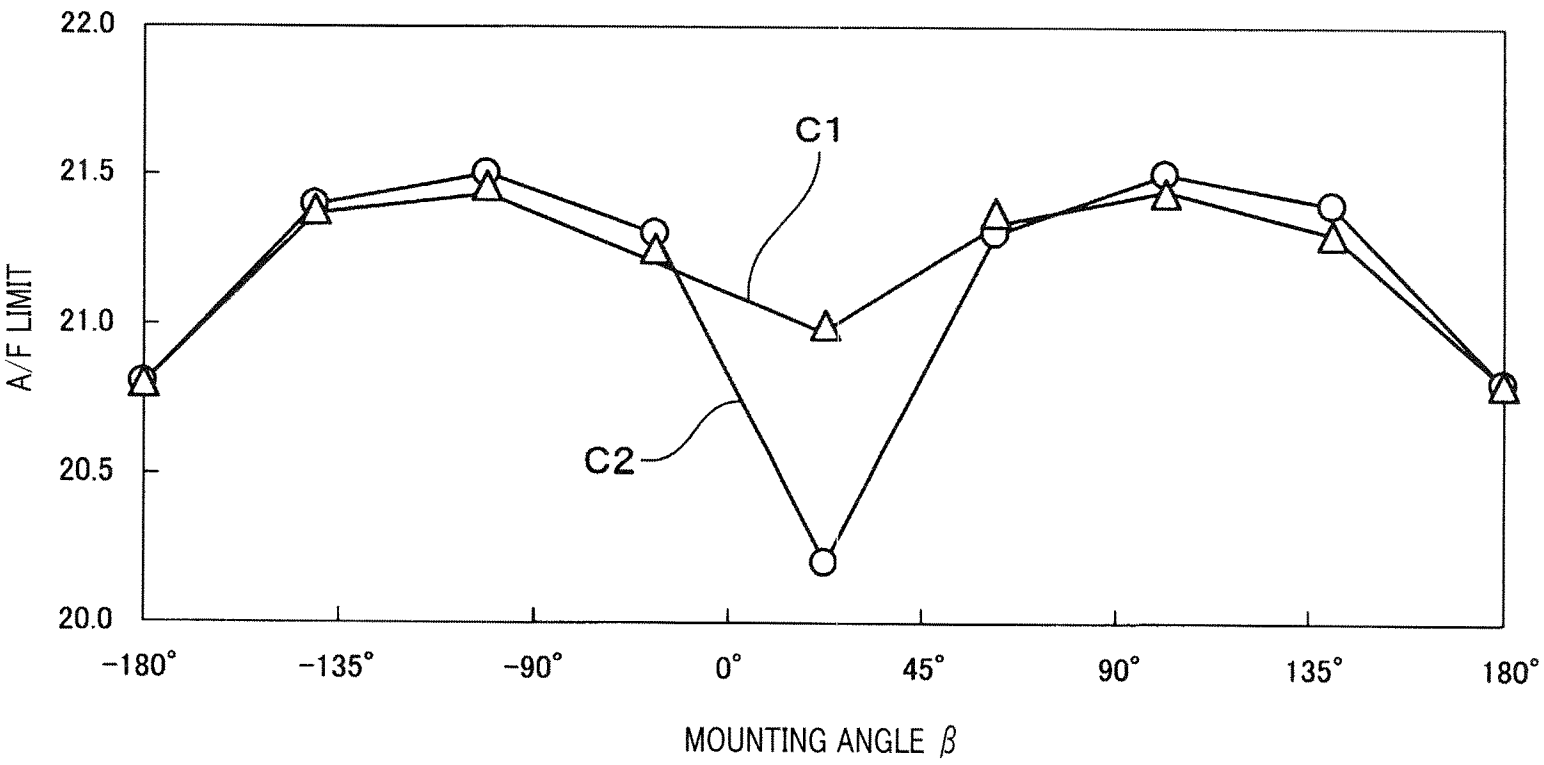
FIG. 27 is a diagram showing test results in a second experiment.

In this experiment, as shown in FIG. 27, using the spark plug 1 of the second embodiment (FIGS. 14-17) and the spark plug 905 of the fifth comparative example (FIG. 24), it was investigated how the A/F limit varies depending on the arrangement position of the standing portion 51 of the ground electrode 5 with respect to the gas flow F.

Specifically, each of the spark plugs was mounted in the combustion chamber of a specific cylinder of a 1800 cc four-cylinder engine; in the specific cylinder, there was mounted a fuel pressure sensor. Moreover, when viewed from the distal side in the axial direction of the spark plug, the angle (mounting angle β) between the upstream direction of the gas flow F and the arrangement position of the standing portion 51 of the ground electrode 5 with respect to the spark discharge gap G was varied in the range of −180° to 180° at intervals of 45°; in each state, the A/F limit was measured. That is, when the mounting angle β was equal to 0°, the standing portion 51 of the ground electrode 5 was located upstream of the spark discharge gap G; when the mounting angle β was equal to) 180° (−180°, the standing portion 51 of the ground electrode 5 was located downstream of the spark discharge gap G.

For each of the spark plug 1 of the second embodiment and the spark plug 905 of the fifth comparative example, with the flow speed of the gas flow F set to 20 m/s, the A/F limit was measured varying the orientation to the gas flow F as described above.

Specifically, in each arrangement state of the spark plug, the engine was operated with the number of revolutions of the engine set to 2000 rpm. Then, under a condition that the indicated mean effective pressure Pmi be equal to 0.28 MPa, the COV (Coefficient OF Variance) was measured based on the output of the fuel pressure sensor while gradually varying the A/F (Air/Fuel) ratio, and the A/F limit was checked up.

In addition, the COV was represented by (standard deviation/average)×100% of the indicated mean effective pressure Pmi. Moreover, the A/F limit was represented by the limit value of air/fuel ratio at which it was possible to ignite the air-fuel mixture. In the present experiment, the A/F limit was set to the value of A/F when the COV became higher than a value at which it was possible for the engine to operate smoothly.

The measurement results of the A/F limit are shown in FIG. 27. In the figure, the polyline designated by the broken line C1 represents the measurement results for the spark plug 1 of the second embodiment; the polyline designated by the broken line C2 represents the measurement results for the spark plug 905 of the fifth comparative example. Moreover, on the graph of the figure, the horizontal axis indicates the mounting angle β; the vertical axis indicates the A/F limit. The higher the A/F limit, the higher the ignition capability.

As shown in FIG. 27, for the polyline graph C2 representing the A/F limit in the spark plug 905 of the fifth comparative example, the A/F limit varied greatly depending on the mounting angle β. This means that the A/F limit, i.e., the ignition capability of the spark plug 905 of the fifth comparative example varied greatly depending on the direction of the gas flow F with respect to the spark plug 905, in other words, depending on the mounting state of the spark plug 905 to the internal combustion engine. In particular, it can be seen that the A/F limit was extremely low at the position where the mounting angle β was equal to 0°. That is, it has been made clear that when the standing portion 51 of the ground electrode 5 is located on the upstream side of the gas flow F to the spark discharge gap G, the A/F limit may be extremely lowered and thus the ignition capability may be greatly lowered.

In contrast, the polyline graph C1, which represents the A/F limit in the spark plug 1 of the second embodiment, indicates that the A/F limit was improved even when the mounting angle β was equal to 0°. This means that it was possible to secure a sufficient ignition capability of the spark plug 1 regardless of the mounting state of the spark plug 1 to the internal combustion engine. Therefore, it has been made clear that the spark plug 1 of the second embodiment can secure the ignition capability regardless of the mounting state of the spark plug 1 to the internal combustion engine.

Third Embodiment

Figure 28:
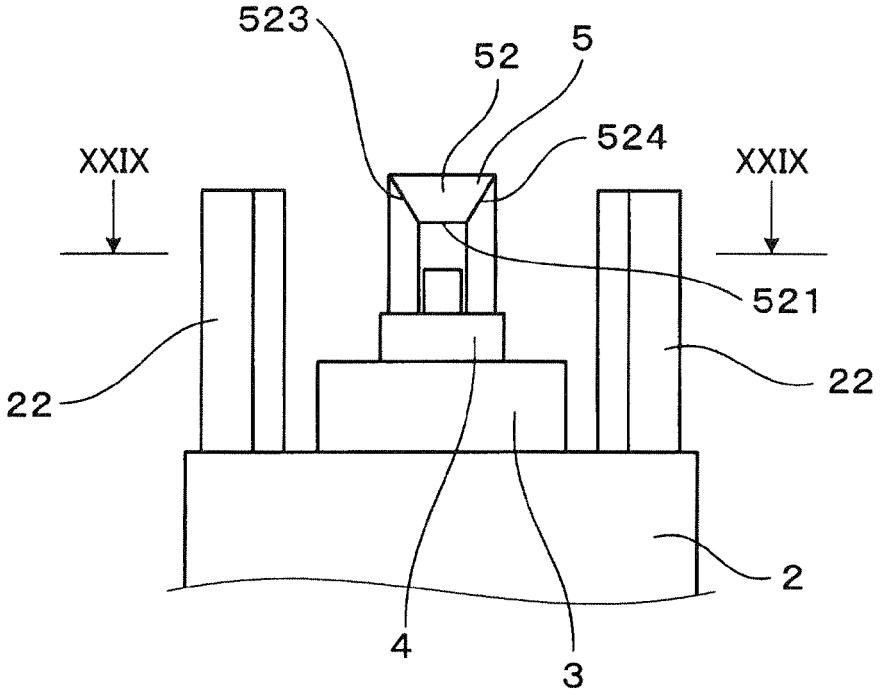
FIG. 28 is a front view of a distal part of a spark plug according to a third embodiment.
Figure 29:
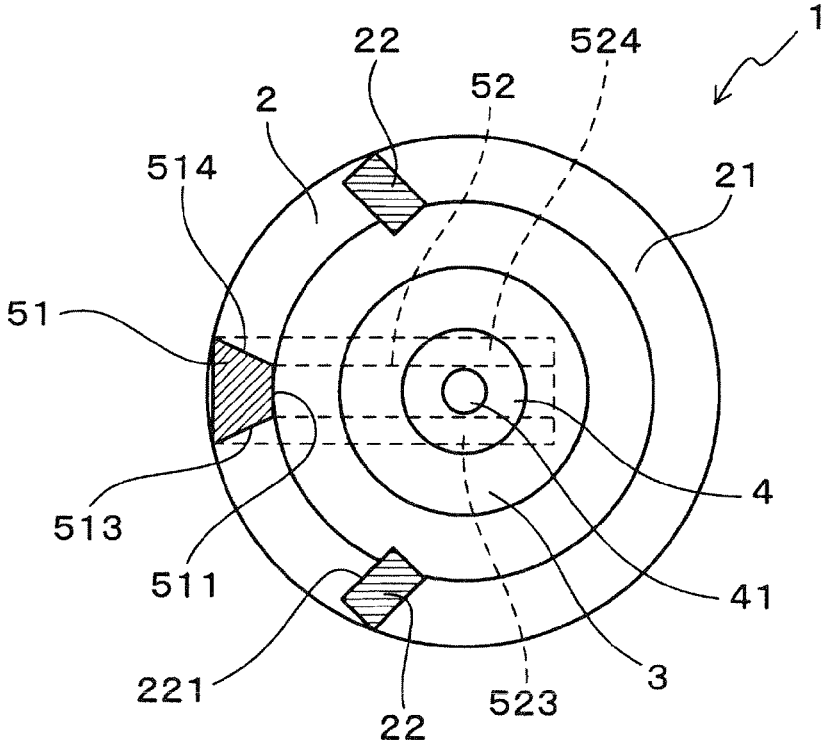
FIG. 29 is a cross-sectional view taken as indicated by arrows XXIX-XXIX in FIG. 28.

In the present embodiment, as shown in FIGS. 28-29, the pair of side surfaces 523 and 524 of the opposing portion 52 of the ground electrode 5 are both inclined at an obtuse angle to the opposing surface 521.

Moreover, the pair of circumferential side surfaces 513 and 514 of the standing portion 51 of the ground electrode 5 are both inclined at an obtuse angle to the radially inner side surface 511. Further, the guide member 22 is provided on both sides of the ground electrode 5 in the plug circumferential direction. That is, there are provided two guide members 22 so as to interpose the standing portion 51 of the ground electrode 5 therebeween in the plug circumferential direction.

The other details are the same as in the first embodiment. In addition, unless specified otherwise, of the reference signs used in the present embodiment and the drawings relating to the present embodiment, those which are the same as the reference signs used in the first embodiment designate the same components as in the first embodiment.

In the present embodiment, it is possible to achieve the same operational effects as in the first embodiment.

Fifth Embodiment

Figure 30:
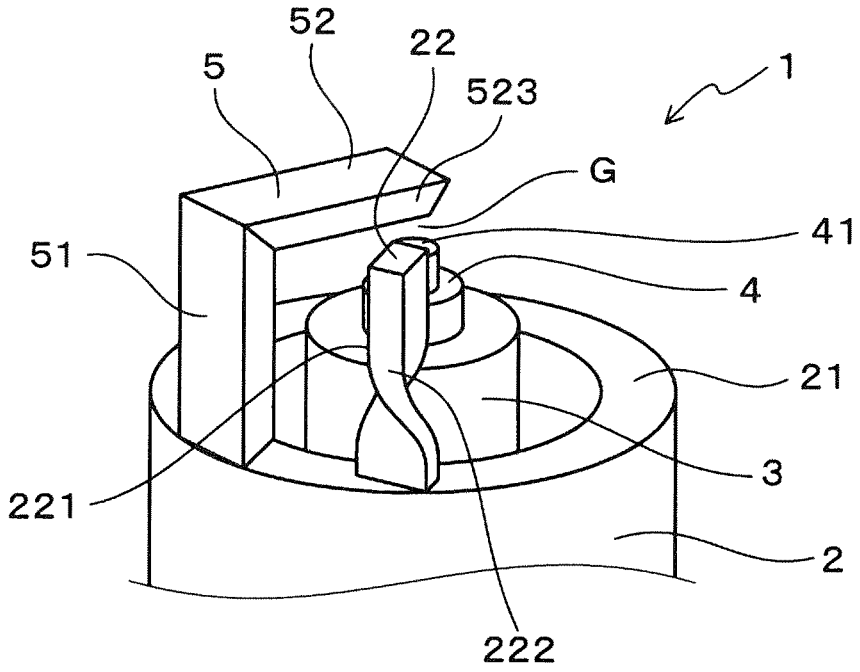
FIG. 30 is a perspective view of a distal part of a spark plug according to a fourth embodiment.

In the present embodiment, as shown in FIG. 30, there is provided a twisted portion 222 in the guide member 22.

Specifically, the guide member 22 has the twisted portion 222 at a position in the axial direction of the spark plug 1 between a proximal portion joined to the distal end 21 of the housing 2 and a portion defining the guide surface 221. The guide member 22 has the shape of twisting a quadrangular prismatic material, which has a rectangular cross-sectional shape, about its central axis at the twisted portion 222 by substantially 90°.

The guide surface 221 is formed on the distal side of the twisted portion 222. It is preferable that the twisted portion 222 is formed on the proximal side of the spark discharge gap G. Consequently, it is possible to form the guide surface 221 over the entire length of the spark discharge gap G in the axial direction of the spark plug 1. Further, it is preferable that the twisted portion 222 is formed on the proximal side of the distal end of the insulator 3.

The other details are the same as in the first embodiment. In addition, unless specified otherwise, of the reference signs used in the present embodiment and the drawings relating to the present embodiment, those which are the same as the reference signs used in the first embodiment designate the same components as in the first embodiment.

In the present embodiment, it is possible to achieve the same operational effects as in the first embodiment.

Fifth Embodiment

Figure 31:
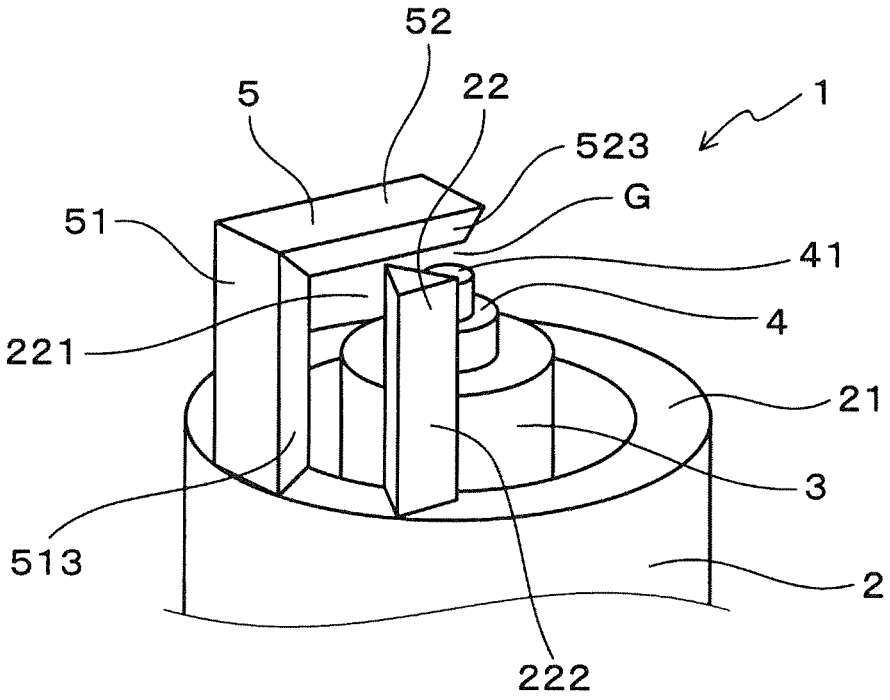
FIG. 31 is a perspective view of a distal part of a spark plug according to a fifth embodiment.

In the present embodiment, as shown in FIG. 31, the cross section of the guide member 22 in a plane perpendicular to the axial direction of the spark plug 1 has a triangular shape. That is, the guide member 22 has a triangular prismatic shape.

In particular, in the present embodiment, the above cross-sectional shape is an equilateral-triangular shape. Further, the guide surface 221 is formed on one surface of the guide member 22 which corresponds to one side of the triangular shape.

The other details are the same as in the first embodiment. In addition, unless specified otherwise, of the reference signs used in the present embodiment and the drawings relating to the present embodiment, those which are the same as the reference signs used in the first embodiment designate the same components as in the first embodiment.

In the present embodiment, it is possible to achieve the same operational effects as in the first embodiment.

Sixth Embodiment

Figure 32:
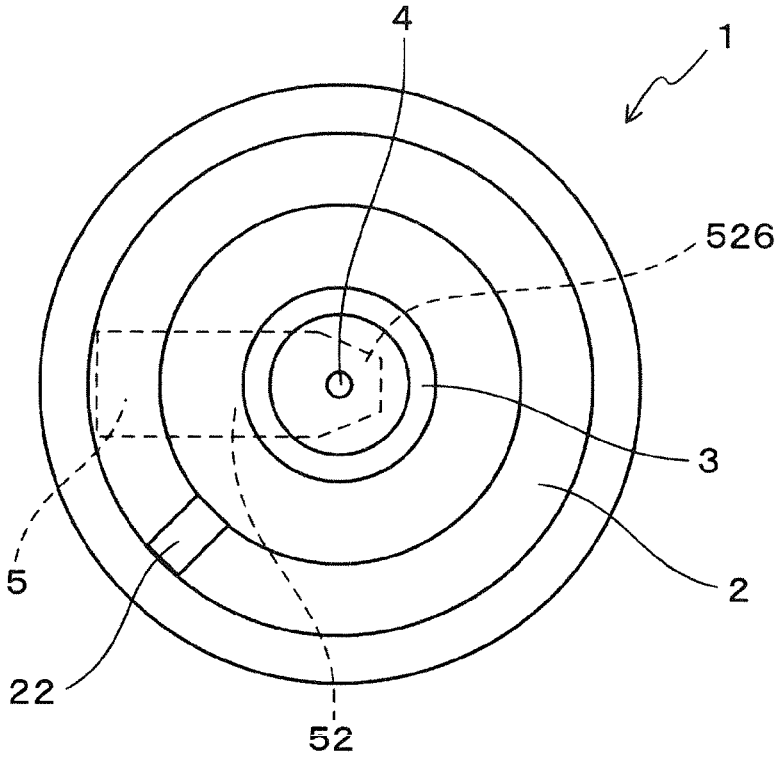
FIG. 32 is a plan view, from the distal side, of a distal part of a spark plug according to a sixth embodiment.
Figure 33:
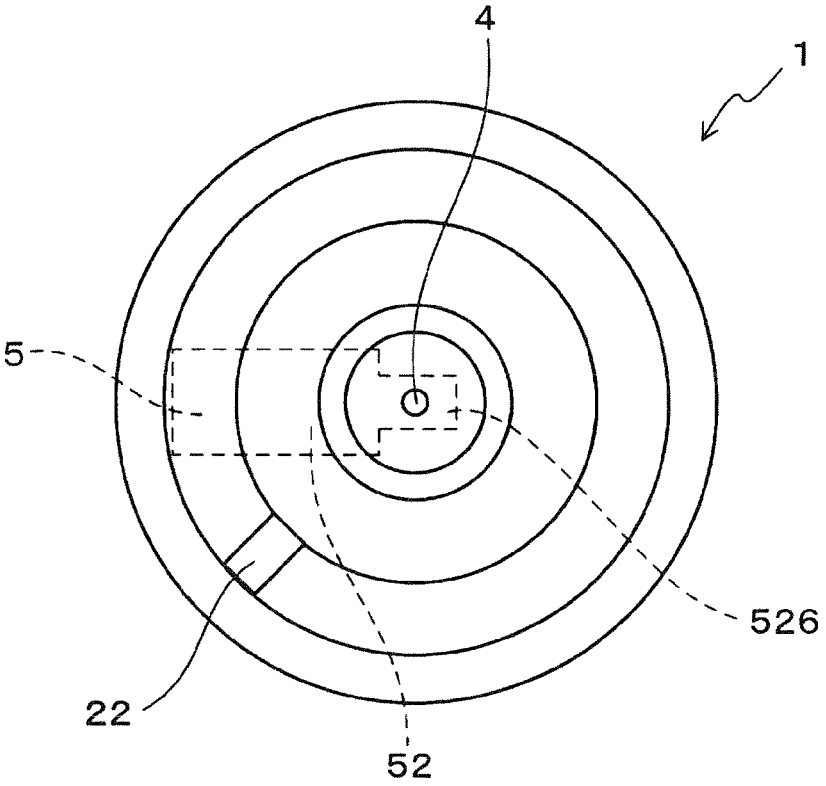
FIG. 33 is a plan view, from the distal side, of a distal part of another spark plug according to the sixth embodiment.

This embodiment illustrates, as shown in FIGS. 32-33, a spark plug 1 in which the opposing portion 52 of the ground electrode 5 has, at the end thereof on the opposite side to the standing portion 51, a small-width part 526 that has a smaller width in a direction perpendicular to both the extending direction of the opposing portion 52 and the axial direction of the spark plug 1 than other parts.

The shape of the small-width portion 526 may be, for example, as shown in FIG. 32, a taper shape of gradually reducing the width of an end part of the opposing portion 52. Alternatively, as shown in FIG. 33, the shape of the small-width portion 526 may be a small-width rectangular shape protruded toward the opposite side to the standing portion 51.

In addition, though not shown graphically, in the present embodiment, the side surface 523 of the opposing portion 52 on the guide member 22 side is formed so as to make an obtuse angle with the opposing surface 521. Further, it is preferable that the side surface 523 at the small-width part 526 is also inclined at the obtuse angle to the opposing surface 521.

The other details are the same as in the first embodiment. In addition, unless specified otherwise, of the reference signs used in the present embodiment and the drawings relating to the present embodiment, those which are the same as the reference signs used in the first embodiment designate the same components as in the first embodiment.

In the present embodiment, it is possible to reduce the width of the opposing portion 52 in the vicinity of the spark discharge gap G. Consequently, it is possible to suppress the opposing portion 52 from impeding the gas flow toward the spark discharge gap G, thereby improving the ignition capability of the spark plug 1. Furthermore, with provision of the small-width part 526, it is easy for a flame core produced in the spark discharge gap G to grow; from this perspective as well, it is possible to improve the ignition capability of the spark plug 1.

In addition, in the present embodiment, it is possible to achieve the same operational effects as in the first embodiment.

It should be noted that the cross-sectional shape of the ground electrode is not limited to the above-described embodiments. Various shapes, such as a shape in which the side surface of the opposing portion on the guide member side is curved, may be employed as the cross-sectional shape of the ground electrode.

Moreover, the shape of the guide member is also not particularly limited. Various shapes other than the above-described rectangular cross-sectional shape and triangular cross-sectional shape, such as a hexagonal cross-sectional shape, a trapezoidal cross-sectional shape or a fan-like cross-sectional shape, may be employed as the shape of the guide member.

DESCRIPTION OF REFERENCE SIGNS

1 spark plug
2 housing
21 distal end
22 guide member
221 guide surface
3 insulator
4 center electrode
41 distal end portion
5 ground electrode
51 standing portion
52 opposing portion
521 opposing surface
522 back surface
523, 524 side surfaces
G spark discharge gap

The invention claimed is:

1. A spark plug for an internal combustion engine, comprising:

a tubular housing;

a tubular insulator held inside the housing;

a center electrode held inside the insulator such that a distal end portion protrudes;

a ground electrode including a standing portion that stands distalward from a distal end of the housing and an opposing portion that is bent radially inward from the standing portion and opposes the center electrode in an axial direction of the spark plug through a spark discharge gap formed between it and the center electrode; and a guide member for guiding a flow of an air-fuel mixture in a combustion chamber of an internal combustion engine to the spark discharge gap, the guide member protruding distalward from the distal end of the housing at a different circumferential position from the ground electrode and having a guide surface that faces the standing portion of the ground electrode, wherein the opposing portion of the ground electrode has an opposing surface that opposes the center electrode, a back surface on the opposite axial side to the opposing surface, and a pair of side surfaces that connect the opposing surface and the back surface, and of the pair of side surfaces, at least the side surface on the guide member side is formed so as to make an obtuse angle with the opposing surface.

2. The spark plug for an internal combustion engine as set forth in claim 1, further wherein the standing portion of the ground electrode has a radially inner side surface that faces the center electrode, a radially outer side surface on the opposite radial side to the radially inner side surface, and a pair of circumferential side surfaces that connect the radially inner side surface and the radially outer side surface, and of the pair of circumferential side surfaces, at least the circumferential side surface on the guide member side is formed so as to make an obtuse angle with the radially inner side surface.

3. The spark plug for an internal combustion engine as set forth in claim 1, further wherein the opposing portion has, at an end on the opposite side to the standing portion, a small-width part that has a smaller width in a direction perpendicular to both the extending direction of the opposing portion and the axial direction of the spark plug than other parts.

4. The spark plug for an internal combustion engine as set forth in claim 1, further wherein the guide member has its distal end located flush with or proximalward from a distal end of the ground electrode and flush with or distalward from a distal end of the insulator.

5. The spark plug for an internal combustion engine as set forth in claim 1, further wherein the guide member protrudes parallel to the axial direction of the spark plug.

* * * * *